US010557297B2

(12) United States Patent
Stenhouse et al.

(10) Patent No.: US 10,557,297 B2
(45) Date of Patent: Feb. 11, 2020

(54) MULTI PANEL COMPONENTS

(71) Applicant: ASSA ABLOY NEW ZEALAND LIMITED, North Shore City (NZ)

(72) Inventors: Damon Peter Stenhouse, Auckland (NZ); Nolan Couzyn, Auckland (NZ); Bryce Alan Molloy, Auckland (NZ); Peter Qin, Guangdong Province (CN)

(73) Assignee: ASSA ABLOY NEW ZEALAND LIMITED, North Shore City (NZ)

( * ) Notice: Subject to any disclaimer, the term of this patent is extended or adjusted under 35 U.S.C. 154(b) by 0 days.

(21) Appl. No.: 16/230,056

(22) Filed: Dec. 21, 2018

(65) Prior Publication Data

US 2019/0194995 A1 Jun. 27, 2019

(30) Foreign Application Priority Data

Dec. 21, 2017 (AU) ..... 2017279738

(51) Int. Cl.
*E05D 15/00* (2006.01)
*E05D 15/26* (2006.01)
(Continued)

(52) U.S. Cl.
CPC ..... *E05D 15/264* (2013.01); *E05D 7/0027* (2013.01); *E05D 15/26* (2013.01);
(Continued)

(58) Field of Classification Search
CPC ..... E06B 3/481; Y10T 16/35; Y10T 16/364; Y10T 16/381; Y10T 16/3813;
(Continued)

(56) References Cited

U.S. PATENT DOCUMENTS 1,192,966 A * 8/1916 Willard ..... E05D 15/0634 16/103
1,821,697 A * 9/1931 Ferris ..... E05D 15/12 16/104
(Continued)

FOREIGN PATENT DOCUMENTS

AU 549443 B3 3/1986
AU 105746 2/1995
(Continued)

OTHER PUBLICATIONS

U.S. Pat. No. 1,285,93 issued Jul. 2, 1872 (would not enter in U.S. area).

*Primary Examiner* — Johnnie A. Shablack
(74) *Attorney, Agent, or Firm* — Sheridan Ross P.C.

(57) ABSTRACT

A panel carriage hanger designed to travel slidable along a track, the panel carriage hanger having a cylindrical bore in a body, the bore having a lip substantially at a first end, the lip having a plurality of castellations. An anti-rotating sleeve having a plurality of castellations is located in the bore, and a biasing mechanism provides a substantially downwards force to the anti-rotating sleeve to mate the castellations. The anti-rotating sleeve movable substantially upwards from a first position in the bore where the castellations of the anti-rotating sleeve and the castellations of the bore mate such that the anti-rotating sleeve cannot rotate into a second position in the bore where the anti-rotating sleeve can rotate. A rod passing through and keyed to the anti-rotating sleeve such that the rod and the anti-rotating sleeve can rotate together, or both cannot rotate.

14 Claims, 23 Drawing Sheets

(51) Int. Cl.
*E05D 7/00* (2006.01)
*E06B 3/48* (2006.01)

(52) U.S. Cl.
CPC ..... *E06B 3/481* (2013.01); *E05Y 2201/244* (2013.01); *E05Y 2201/474* (2013.01); *E05Y 2600/14* (2013.01); *E05Y 2900/132* (2013.01); *E05Y 2900/142* (2013.01)

(58) Field of Classification Search
CPC ..... Y10T 16/3816; Y10T 16/3819; Y10T 16/3825; Y10T 16/3837; Y10T 16/384; Y10T 16/3834; E05D 15/0621; E05D 15/0626; E05D 15/063; E05D 15/0639; E05D 15/066; E05D 15/0665; E05D 15/0673; E05D 15/0678; E05D 15/0643; E05D 15/0634; E05D 15/0669
See application file for complete search history.

(56) References Cited

U.S. PATENT DOCUMENTS 2,994,099 A * 8/1961 Richards ..... E05D 15/26 16/105
3,193,870 A * 7/1965 McNinch ..... E05D 15/063 16/105
3,295,257 A * 1/1967 Douglass ..... E06B 3/481 160/199
3,492,687 A * 2/1970 Herr ..... B61D 19/009 16/105
3,597,790 A * 8/1971 Kellems ..... E05D 15/266 16/244
3,670,795 A 6/1972 Kupfrian
3,683,453 A 8/1972 McLeland et al.
3,783,930 A * 1/1974 Williams ..... E05D 15/26 160/199
3,805,324 A * 4/1974 Johnson ..... E05D 7/0027 16/244
4,607,965 A * 8/1986 Belanger ..... E05D 15/063 384/276
4,837,891 A * 6/1989 Toma ..... E05D 15/0613 104/111
4,837,893 A 6/1989 Wilson
4,991,257 A * 2/1991 Eutebach ..... E05D 15/0613 104/246
5,042,555 A * 8/1991 Owens ..... E04B 2/827 160/116
5,085,262 A * 2/1992 Tutikawa ..... E05D 15/26 160/199
5,090,171 A * 2/1992 Kano ..... E04B 2/827 160/199
5,396,493 A 3/1995 Sugiyama
5,694,665 A 12/1997 Strickland et al.
5,701,636 A 12/1997 Jahnke
5,701,941 A * 12/1997 Pasternak ..... E05D 15/26 16/87 R
5,713,105 A * 2/1998 Toomey ..... E05D 7/0423 16/238
6,374,456 B1 * 4/2002 Fort ..... E05D 15/0613 16/87.6 R
6,598,355 B2 * 7/2003 Owens ..... E04B 2/827 16/87 R
6,618,900 B2 * 9/2003 Spork ..... E05D 15/063 16/87 R
6,647,896 B1 * 11/2003 Nottingham ..... B61D 19/00 105/378
6,698,491 B2 * 3/2004 Goldsmith ..... E05D 15/063 160/185
6,834,703 B2 * 12/2004 Pacholke ..... E05D 3/022 160/206
7,246,412 B2 * 7/2007 Pacholke ..... E05D 15/0634 16/264
7,552,511 B2 6/2009 Campbell et al.
7,676,887 B2 3/2010 Chung
7,694,389 B2 4/2010 Erickson et al.
8,046,872 B2 * 11/2011 Burgess, III ..... E05D 15/0639 16/103
8,074,699 B2 * 12/2011 Jones ..... E05D 15/0656 160/199
8,429,794 B2 4/2013 Tagtow et al.
8,677,564 B2 * 3/2014 Pelekanos ..... E05D 15/26 16/105
8,844,604 B2 * 9/2014 Pelekanos ..... E05D 15/0656 16/87 R
8,857,015 B2 * 10/2014 Hufen ..... E05D 15/063 16/91
8,984,716 B2 * 3/2015 Proctor ..... E05D 15/063 16/97
9,032,588 B2 * 5/2015 Chen ..... E06B 7/28 16/106
9,032,589 B2 * 5/2015 Pelekanos ..... E05D 15/26 16/105
9,157,267 B2 * 10/2015 Pelekanos ..... E05D 15/26
9,689,185 B2 * 6/2017 McInnis ..... E05D 3/022
9,976,329 B1 * 5/2018 Lucci ..... E05D 15/26
10,087,668 B2 * 10/2018 Wang ..... A47H 15/00
10,294,704 B2 * 5/2019 Lang ..... E05D 15/0639
2001/0011583 A1 * 8/2001 Spork ..... E05D 15/26 160/199
2004/0128794 A1 7/2004 Chung
2006/0107490 A1 * 5/2006 Pacholke ..... E05D 15/0634 16/234
2008/0202706 A1 * 8/2008 Fath ..... E05D 15/26 160/199
2009/0289463 A1 * 11/2009 Tsai ..... E05D 15/26 292/341.15
2010/0012280 A1 * 1/2010 Hans ..... E05D 15/26 160/211
2013/0061427 A1 * 3/2013 Lang ..... E05D 7/0423 16/248
2015/0000082 A1 1/2015 Lang et al.
2016/0024826 A1 * 1/2016 Smith ..... E05D 15/26 160/197
2016/0201380 A1 * 7/2016 Scharder ..... E05D 15/0621 160/206
2018/0230728 A1 * 8/2018 Downey ..... E05D 15/0621

FOREIGN PATENT DOCUMENTS

AU 199932368 B2 6/1999
AU 718501 B2 4/2000
AU 92944 5/2001
AU 772955 B2 5/2004
AU 2004202218 B2 1/2009
AU 2011229151 B2 12/2016
AU 359152 11/2019
EP 285229 B1 10/1991
EP 919658 B1 6/2003
GB 0553600 A1 9/1992
GB 2402192 A 12/2004
JP 2002054341 A 2/2002
WO 200163079 A1 8/2001

* cited by examiner

MULTI PANEL COMPONENTS

CROSS REFERENCE TO RELATED APPLICATIONS

This application is a national stage application under 35 U.S.C. 119(b) and 37 CFR 1.55, and claims the benefit of Australian Application No. 2017279738 filed Dec. 21, 2017, the disclosure of which is incorporated herein by reference.

BACKGROUND OF THE INVENTION

1. Field of the Invention

This invention relates to a set of multi panel components, an adjustable hinge a height-adjustable carriage hanger and/or an end guide.

2. Description of Related Art

Multi panel components are used for sliding and folding panels. An example of sliding panels is a bifold door. Sliding panels are typically supported from above by carriage hangers or below by support members and may or may not be hinged to a frame. In this specification, a panel may be a door, a window or other panel type.

One of the difficulties is that when an installer is installing the panels, the frame may not be aligned correctly and so some adjustment needs to be made. These adjustments may include spacing the hinges from the frame and adjusting the location or height of the support in relation to the panel. However, it is difficult for an installer to correctly position and space the hinges and the carriage hangers or supports when installing the panels and so it would be desirable to be able to adjust the hinges and supports with the panels installed.

SUMMARY OF THE INVENTION

Bearing in mind the problems and deficiencies of the prior art, it is therefore an object of the present invention to provide a set of multi panel components, an adjustable hinge and/or a height-adjustable carriage hanger that provides for adjustment of installed panels or at least provides the public or industry with a useful choice.

According to one example embodiment there is provided a panel carriage hanger slidable along a track comprising:

- a body;
- rollers attached to the body to allow the body to travel along the track;
- a cylindrical bore in the body, the axis of the cylindrical bore substantially perpendicular to the direction of travel of the body along the track, and in use the cylindrical bore substantially vertical, the cylindrical bore having first and second ends, the cylindrical bore having a lip substantially at a first end, the lip having a plurality of castellations;
- an anti-rotating sleeve having:
  - first and second ends; and
  - a lip at the second end with a plurality of castellations; the anti-rotating sleeve inserted into the cylindrical bore such that the first end passes through the first end of the cylindrical bore and the castellations of the anti-rotating sleeve mateable with the castellations of the cylindrical bore, the interior of the anti-rotating sleeve being keyed, the anti-rotating sleeve movable from a first position in the bore where the anti-rotating sleeve can rotate in the bore and a second position in the bore where the castellations of the anti-rotating sleeve and the castellations of the cylindrical bore mate such that the anti-rotating sleeve cannot rotate;
- a biasing mechanism providing a force to the anti-rotating sleeve to mate the castellations of the anti-rotating sleeve with the castellations of the cylindrical bore;
- a panel attachment mechanism; and
- a rod having first and second ends, the rod passing through the anti-rotating sleeve, the second end of the rod supported at the second end of the cylindrical bore by a rod support member, the rod further having a keyed portion, the keyed portion of the rod mating with the keyed portion of the anti-rotating sleeve, such that the anti-rotating sleeve and the rod rotate together, the first end of the rod connected to the panel attachment mechanism, wherein rotating the rod when the anti-rotating sleeve is rotatable adjusts the distance between the rod support and the panel attachment mechanism.

Preferably the rod support member is a sleeve inserted into the cylindrical bore substantially at the second end of the cylindrical bore and wherein the rod is threaded at least partially at the second end of the rod and the rod is screwed into the threaded sleeve.

Preferably the panel attachment mechanism is at least one hinge plate.

Preferably the panel attachment mechanism is a leaf or bracket attachable to a panel, wherein the leaf or bracket has a threaded bore and wherein the rod is threaded at least partially at the first end of the rod and the rod is screwed into the threaded bore.

Preferably the biasing mechanism is a spring.

Preferably the panel is a door.

Preferably the track is mounted above a plurality of panels and the panels are hung from the support.

According to a further example embodiment there is provided an end guide for a multi panel system, the end guide locatable in a lower track to guide a panel, the end guide comprising:

- a leaf or bracket securable to a panel;
- a guide base upper having a top and a bottom;
- a pin connecting the leaf or bracket to the top of the guide base upper, the pin defining a pin axis; and
- an elongated roller assembly having first and second ends, having a keyed cavity between the first and second ends, the keyed cavity positionable in a keyed protrusion, the keyed protrusion protruding from the bottom of the guide base upper, the roller assembly further having a plurality of rollers arranged along the elongated assembly slidable along the track,
- wherein the guide base upper and elongated roller assembly are connectable in at least a first position wherein the pin axis is located nearer the first end of the elongated roller assembly than the second end and a second position wherein the pin axis is located nearer the second end of the elongated roller assembly than the first end.

Preferably the keys of the cavity and the protrusion are castellations.

Preferably further including locating surfaces on the guide base upper, the locating surfaces alignable with a side of the elongated roller assembly to define preferred connection positions.

According to another example embodiment there is provided a multi panel system comprising:

- a plurality of panels;

a plurality of hinges connecting at least one panel to a frame and connecting one of the plurality of panels to another of the plurality of panels;

at least one panel carriage hanger; and a track along which the at least one panel carriage hanger can travel.

Preferably at least one of the hinges used to connect at least one panel to the frame is an adjustable hinge; the adjustable hinge comprising:

a hinge leaf in use securable to a panel or a frame; and an adjustable leaf in use securable to a panel or a frame, the adjustable leaf comprising first and second plates, the first and second plates being connected by an adjustable leaf pin, the second plate being connected to the hinge leaf by a hinge pin substantially parallel to the adjustable leaf pin, the hinge pin defining a hinge pin axis, the first and second plates being movable relative to each other such that the distance between the first plate and the hinge pin axis is adjustable to alter the space between a frame and a panel to which the adjustable hinge is attached and the first and second plates being adjustable along the hinge pin axis such that the height of the panel relative to the frame is adjustable.

Preferably the distance between the first plate and the hinge pin axis is adjustable using a screw.

Preferably the relative position of the plates along the axis of the hinge pin is adjustable using at least one screw to position the first plate relative to the second plate.

Preferably the system further includes:

a guide track; and an end guide.

It is acknowledged that the terms "comprise", "comprises" and "comprising" may, under varying jurisdictions, be attributed with either an exclusive or an inclusive meaning. For the purpose of this specification, and unless otherwise noted, these terms are intended to have an inclusive meaning—i.e., they will be taken to mean an inclusion of the listed components which the use directly references, and possibly also of other non-specified components or elements.

Reference to any document in this specification does not constitute an admission that it is prior art, validly combinable with other documents or that it forms part of the common general knowledge.

BRIEF DESCRIPTION OF THE DRAWINGS

The accompanying drawings serve to explain the principles of the invention, in which:

FIG. 13 illustrates an isometric view of a height-adjustable carriage hanger according to a further embodiment of the present invention;

DESCRIPTION OF THE EMBODIMENT(S)

In describing the embodiment of the present invention, reference will be made herein to FIGS. 1-25 of the drawings in which like numerals refer to like features of the invention.

Figure 24:
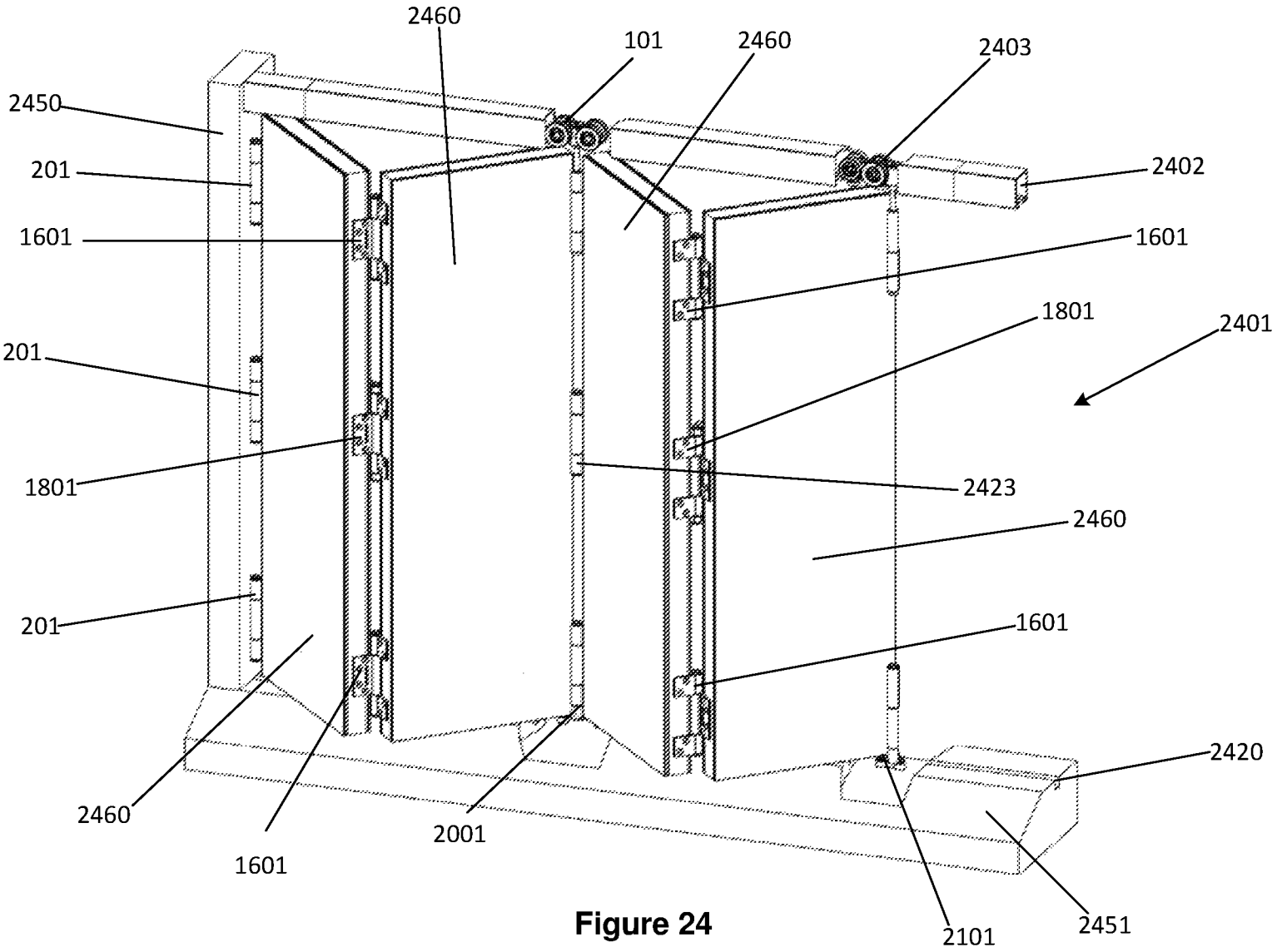
FIG. 24 illustrates a front view of the hardware of the present invention in use on a plurality of sliding panels.
Figure 25:
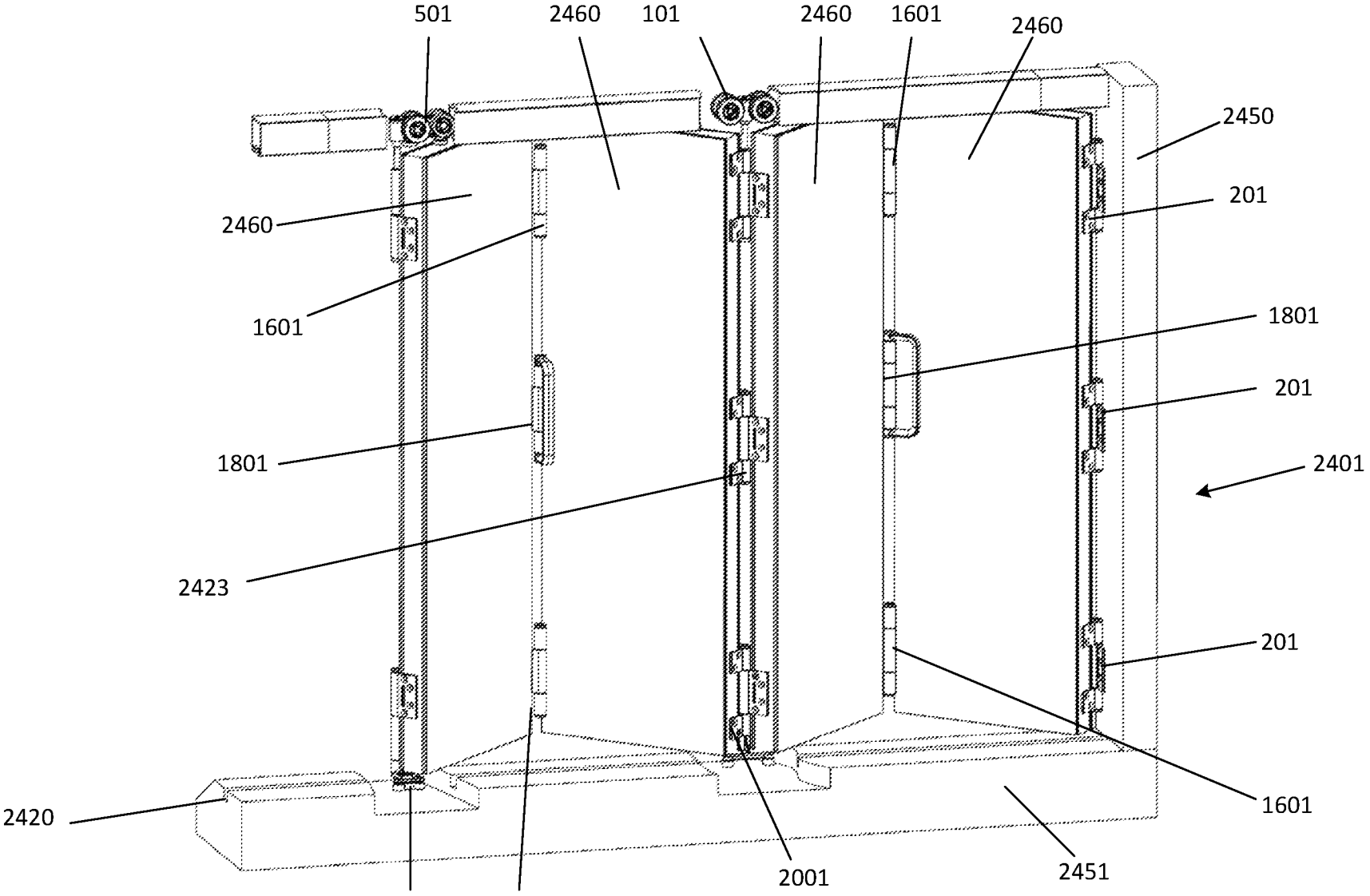
FIG. 25 illustrates a back view the hardware of the present invention in use on a plurality of sliding panels.

FIGS. 24 and 25 illustrate the multi panel components of the invention in use on a set of sliding panels 2401. The components may be used on variety of sliding panels including casement, bifold, pivotfold, centrefold, endfold, multifold and straight sliding panels. The panels 2460 are mounted in a frame, a track 2402 is located at the top of the frame and a guide track 2420 is located at the bottom of the frame 2451. The panels 2460 are hinged to a side of the frame 2450 using adjustable hinges 201. Carriage hangers 101 and 501 travel along track 2402 and support and position the panels 2460. Panel guides 2001, 2101 travel along the guide track 2420 and assist in positioning the panels 2460. The panels 2460 are connected by carriage hangers 101, panel guides 2001, 2101, hinges 1601 and hinge handles 1801. The hinge handles 1801 provide for easier movement of the panels 2460 as they travel along the hanging track 2402 within the frame.

FIGS. 1 to 5 illustrate the height-adjustable carriage hanger 101. The height-adjustable carriage hanger 101 is used for suspending sliding or movable panels which travel along a track. The height-adjustable carriage hanger 101 includes a body 140 and rollers 120 that travel on the track. The rollers are rotatably connected to the body 140 using axles 121. A threaded sleeve or hanger nut 156 is inserted into a cavity or cylindrical bore 160 in the body 140.

The axis of the cylindrical bore 160 substantially perpendicular to the direction of travel of the body along the track, and in use the cylindrical bore is substantially vertical. The cylindrical bore 160 has first 171 and second ends 172, the cylindrical bore has a lip 173 substantially at a first end 171, the lip 173 having a plurality of castellations 151. The hanger nut 156 is inserted into the cylindrical bore from the second end 172 and is prevented from passing through the cylindrical bore by a sill 170 and hanger nut head 157.

A threaded supporting rod 130 is screwed into the hanger nut 156, a hinge, having hinge plates/leaves 110, 111, 112 is supported by the rod 130. The height of the hinge plates 110, 111, 112 is adjustable by turning the rod 130 using a tool inserted in to a hex hole 138 in the head 139 of the rod 130, such that the height of the hinge plates 110, 111, 112 relatively to the body 140 and therefore the panel height is adjustable. Alternatively, the rod head 139 may have a slot suitable for a screwdriver or the head 139 may have another suitable mechanism. In a further alternative, the rod 130 is keyed for at least a portion of the rod length. The keyed surface of the rod 130 provides an in use means for rotating the rod 130. One example of a keyed surface is two flat surfaces on opposed sides of the rod 130. A suitable tool would be used that matched the key of the rod to rotate the rod 130. The rotation of the rod 130 in the hanger nut 156 adjusts the extension of the rod 130.

Figure 14:
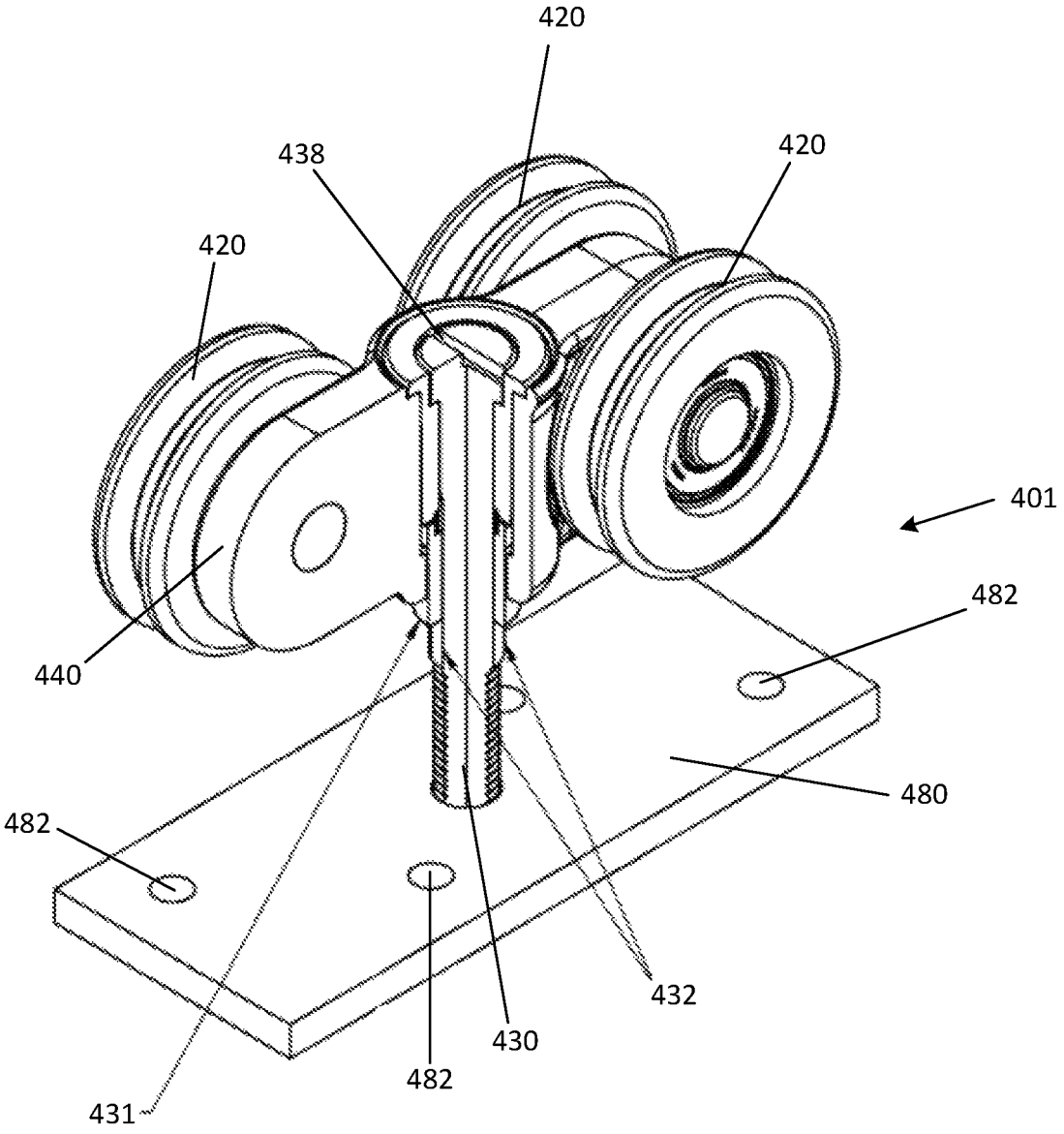
FIG. 14 illustrates an exploded view of the height-adjustable carriage hanger of FIG. 13 to a further embodiment of the present invention.

While the carriage hanger 101 is described above in combination with hinge plates/leaves, other suitable panel attachment mechanisms may be used in combination with the support rod 130 for example as illustrated in FIG. 14 a top mounted support bracket 480.

Figure 6:
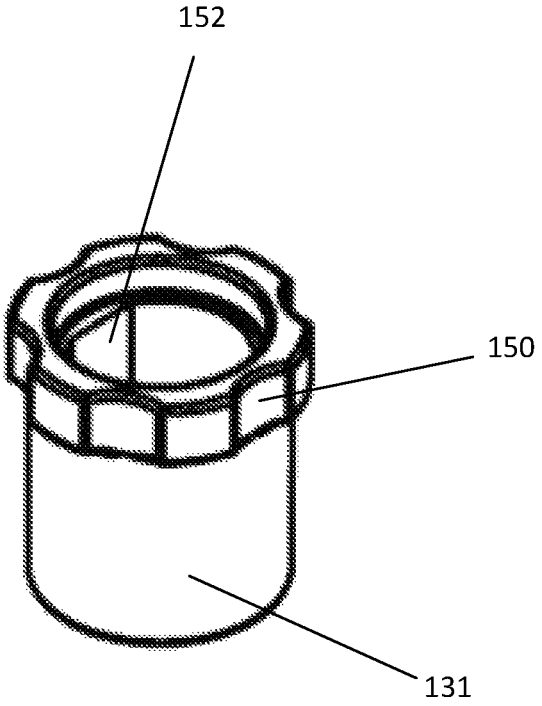
FIG. 6 illustrates an isometric view of an anti-rotating sleeve of a height-adjustable carriage hanger according to an embodiment of the present invention.
Figure 9:
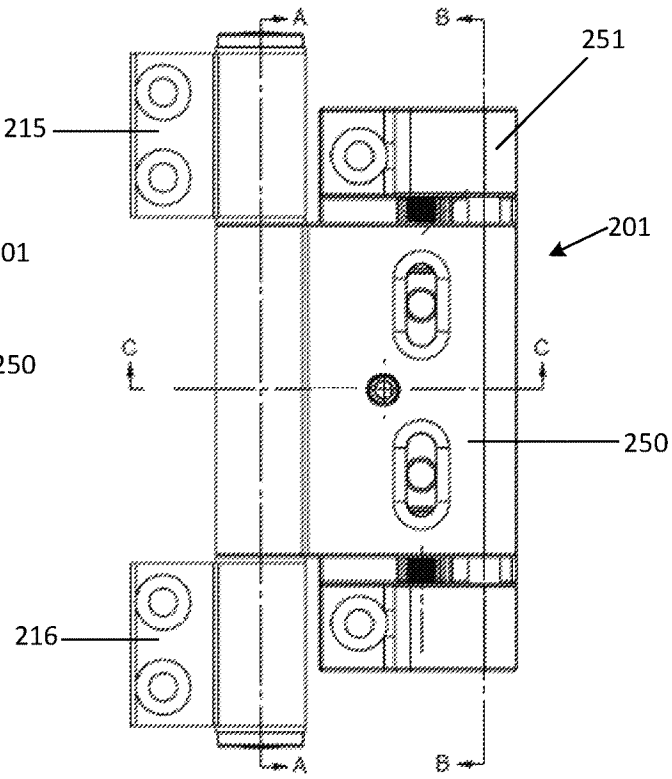
FIG. 9 illustrates a front view of an adjustable hinge according to an embodiment of the present invention.
Figure 8:
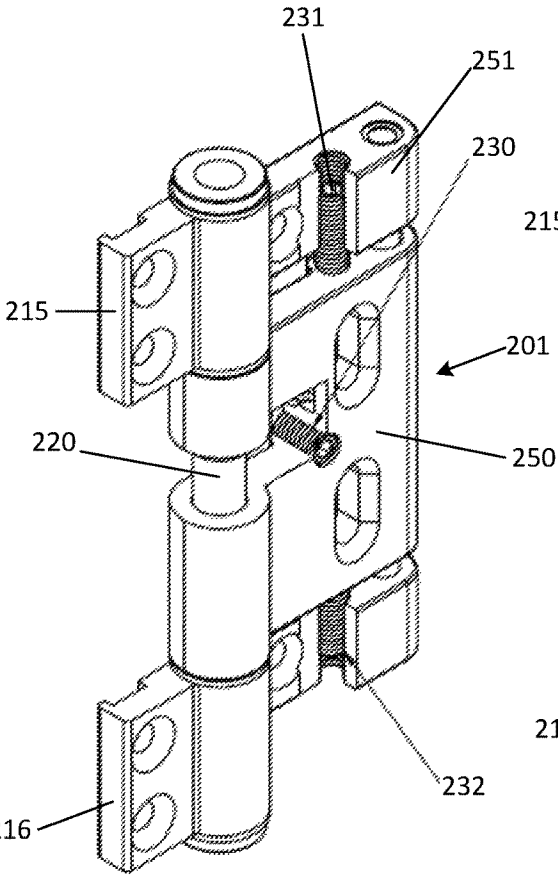
FIG. 8 illustrates a partial cut view of an adjustable hinge according to an embodiment of the present invention.
Figure 7:
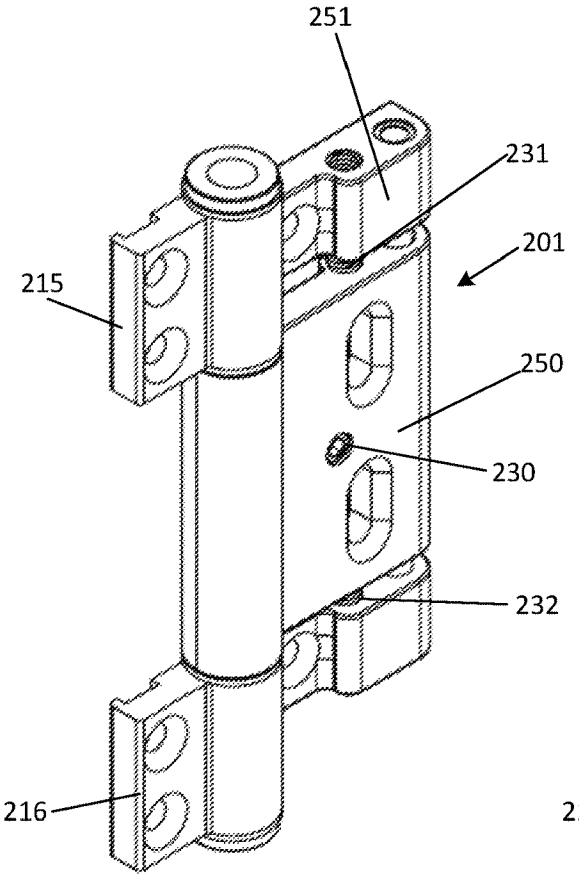
FIG. 7 illustrates a view of an adjustable hinge according to an embodiment of the present invention.
Figure 12:
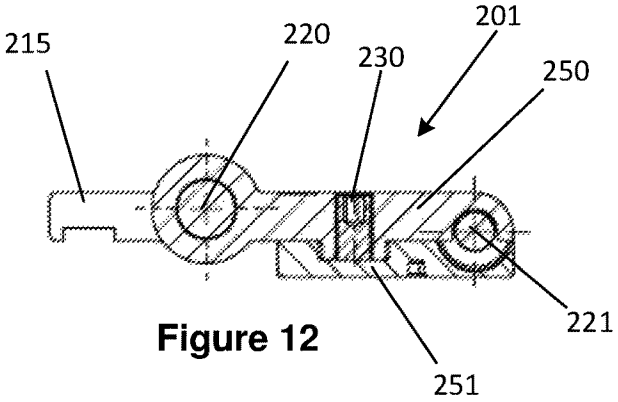
FIG. 12 illustrates a cross section view of the adjustable hinge of FIG. 9 along the line C-C of according to an embodiment of the present invention.
Figure 11:
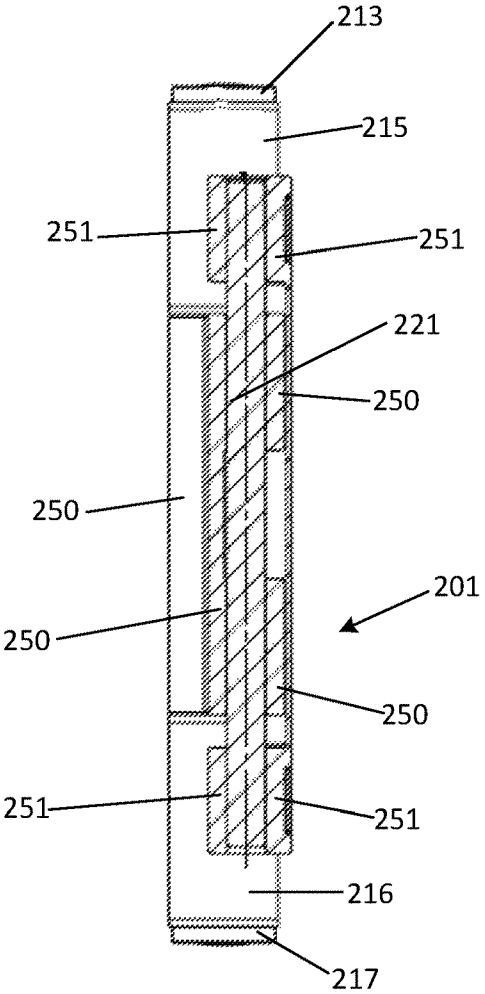
FIG. 11 illustrates a cross section view of the adjustable hinge of FIG. 9 along the line B-B of according to an embodiment of the present invention.
Figure 10:
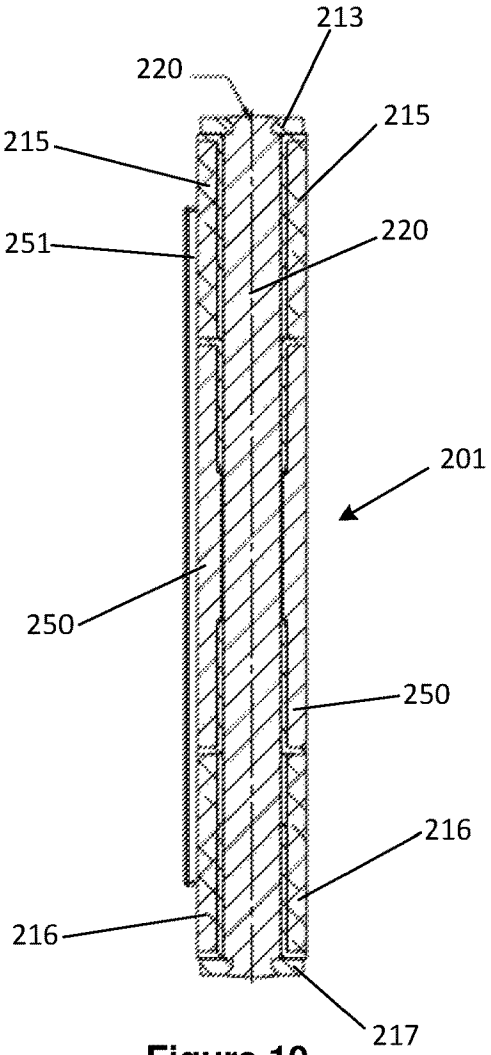
FIG. 10 illustrates a cross section view of the adjustable hinge of FIG. 9 along the line A-A of according to an embodiment of the present invention.

Referring to FIG. 6 an anti-rotating sleeve 131 has protrusions or castellations 150 that combine with protrusions or castellations 151 in cylindrical bore 160 to prevent the anti-rotating sleeve 131 rotating relative to the body 140. The anti-rotating sleeve 131 is inserted into the body cavity 160 before the hanger nut 156. A spring 155, resilient member or other biasing means is located between the hanger nut 156 and the anti-rotating sleeve 131 provides a force to keep the protrusions 150 of the sleeve 131 and the protrusions 151 of the body 140 engaged. Other biasing means could be used including for example a spring located externally over the anti-rotating sleeve 131 between the body 140 and a lip proximal the bottom of the anti-rotating sleeve 131. The biasing means needs to ensure the protrusions 150 of the sleeve 131 and the protrusions 151 of the body 140 are engaged. In a further example, the anti-rotating sleeve 131 could be weighted such that gravity acting on the weighted anti-rotating sleeve is sufficient to ensure the protrusions 150 of the sleeve 131 and the protrusions 151 of the body 140 are engaged.

The interior of the anti-rotating sleeve 131 is keyed, in one example the key is a flat surface 152. The keyed surface 152 engages with a similar keyed surface 153 on the rod 130 to prevent the rod 130 rotating relative to the anti-rotating sleeve 131. The rod 130 is keyed for at least a portion of the rod length. Other example ways to key or mate the anti-rotating sleeve 131 and rod 130 include splines, hex or keyways.

Figure 1:
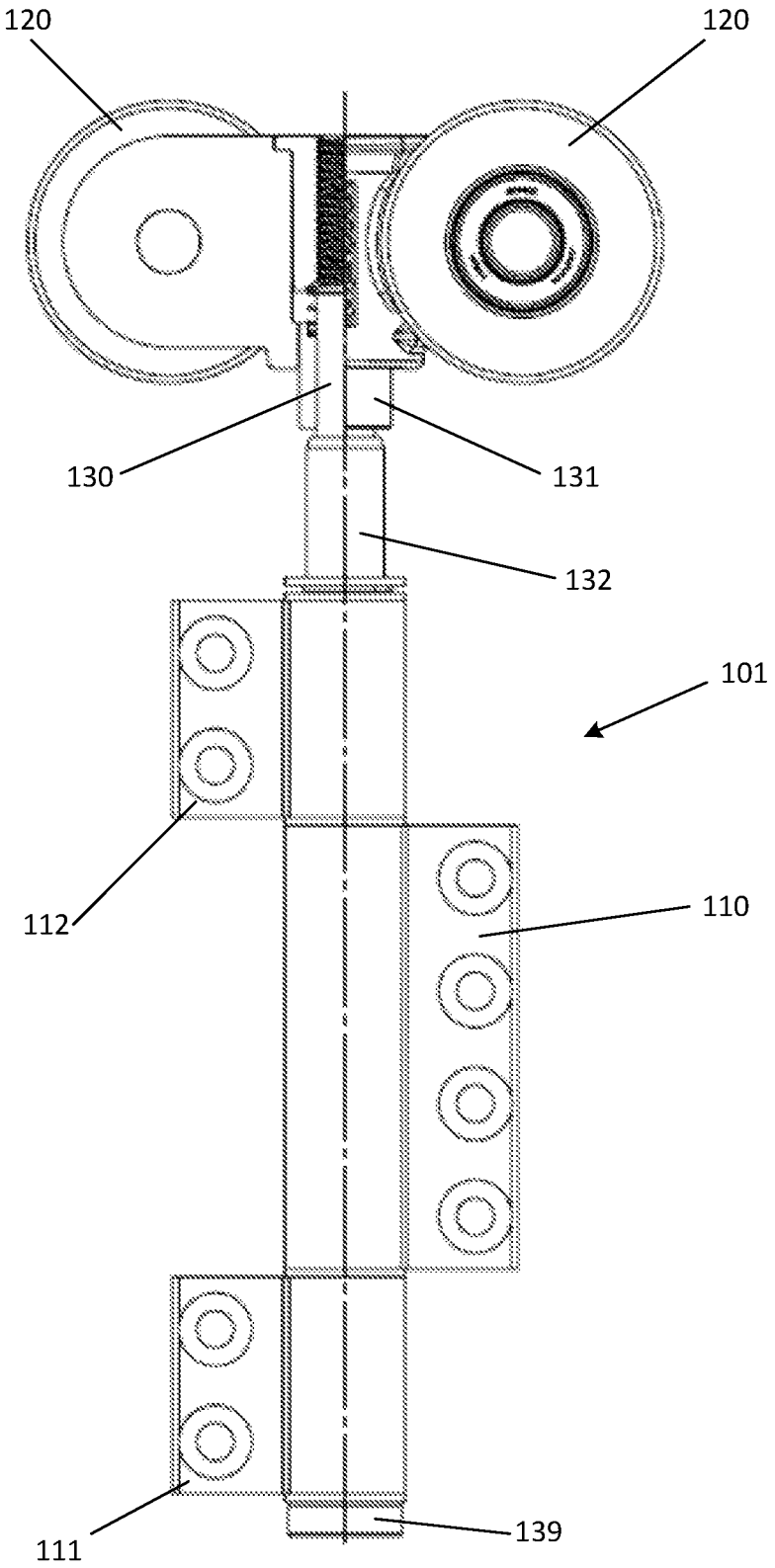
FIG. 1 illustrates a front view of a height-adjustable carriage hanger according to an embodiment of the present invention.
Figure 2:
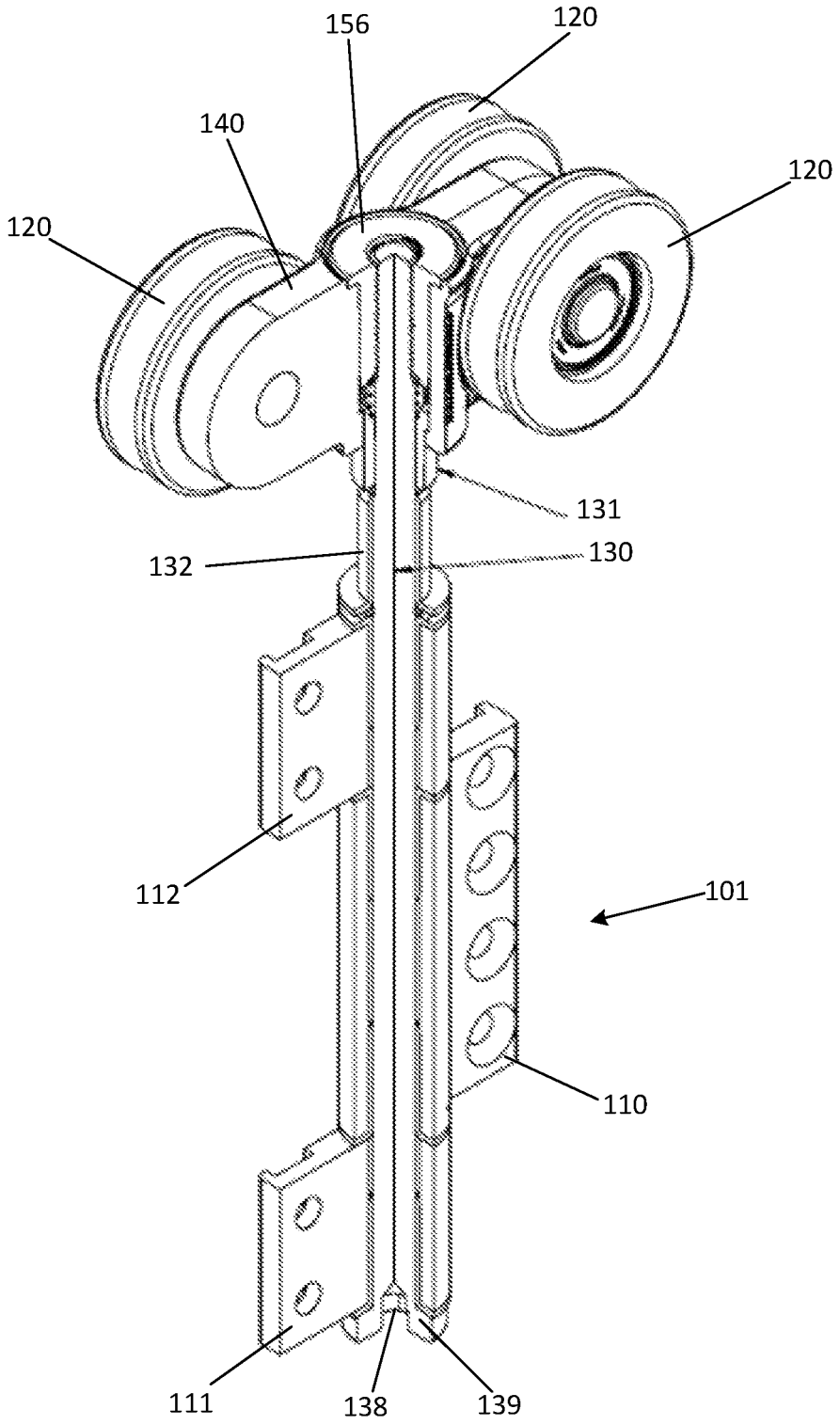
FIG. 2 illustrates a view of a height-adjustable carriage hanger according to an embodiment of the present invention with the rod in a locked position.
Figure 3:
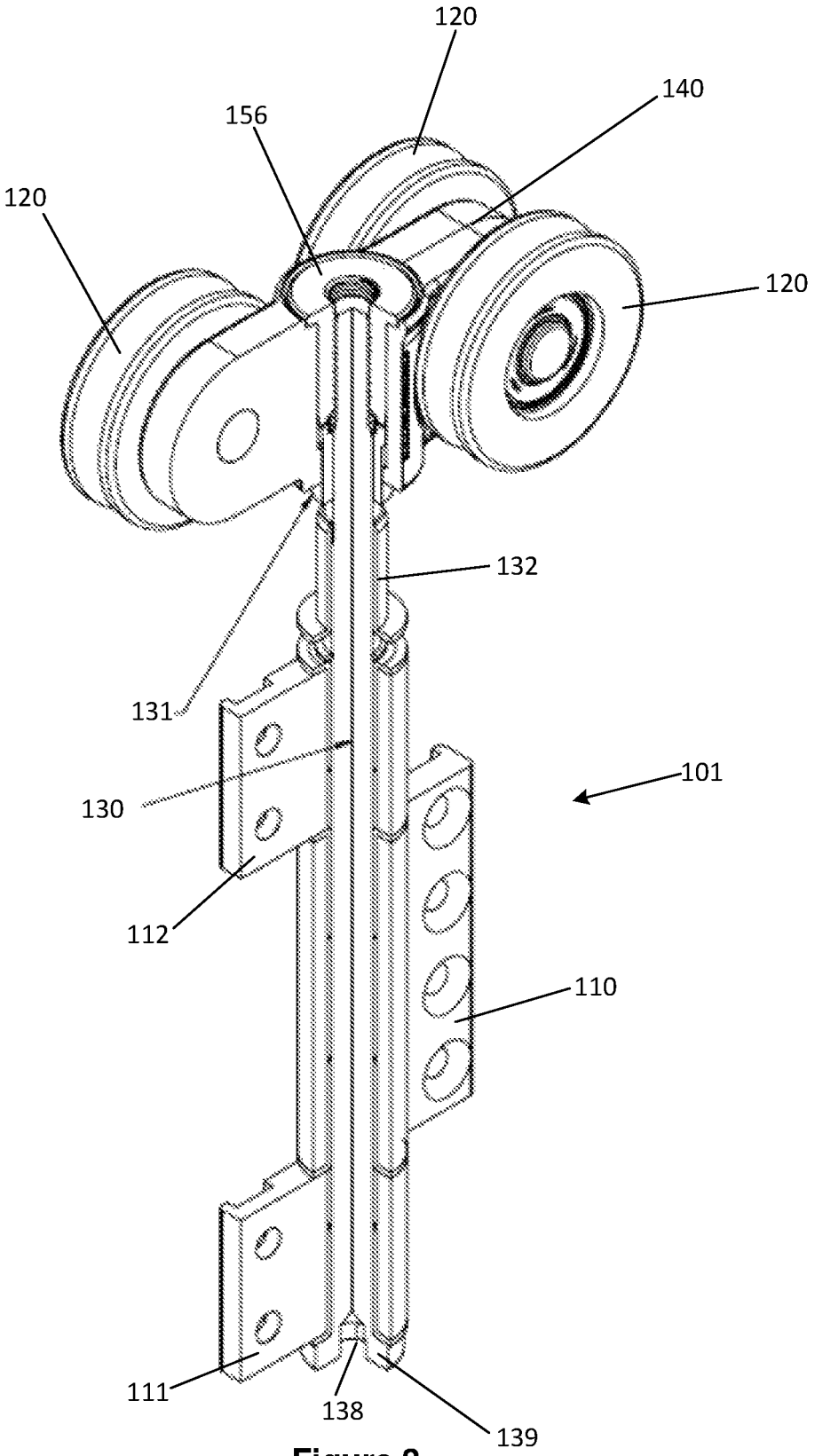
FIG. 3 illustrates a view of a height-adjustable carriage hanger according to an embodiment of the present invention with the rod in an unlocked position.
Figure 4A:
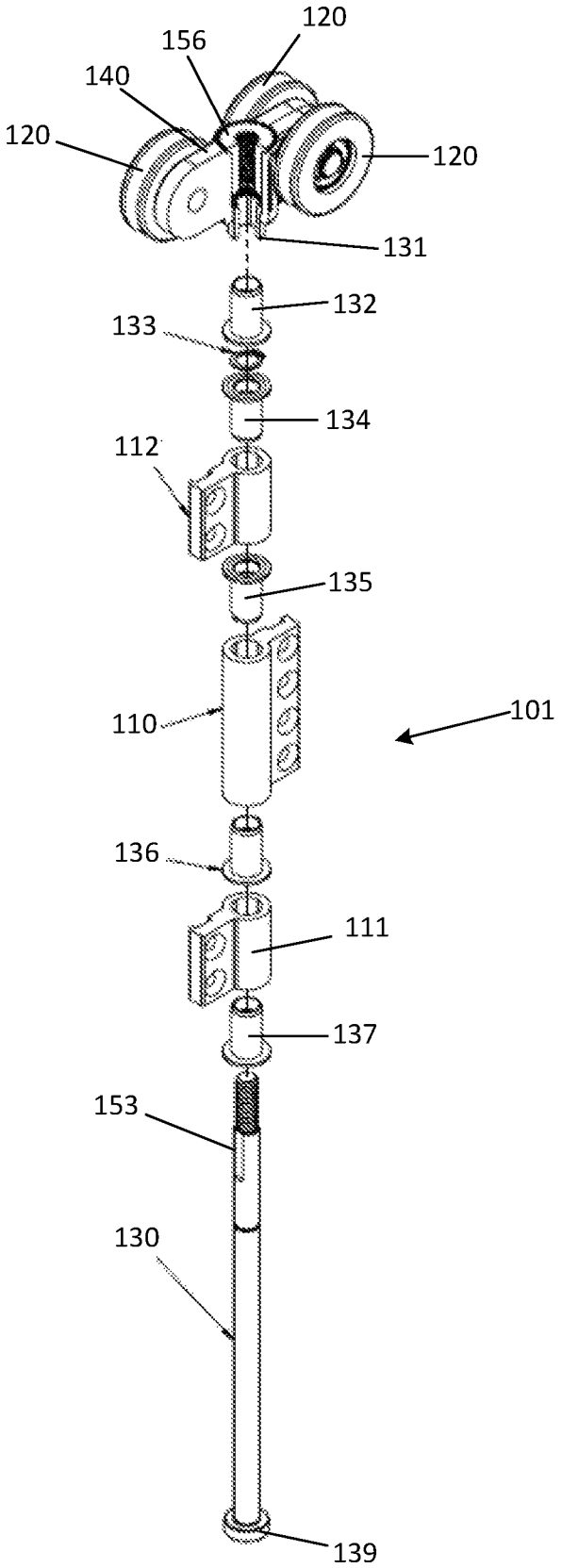
FIG. 4A illustrates an exploded view of a height-adjustable carriage hanger of FIG. 1 according to an embodiment of the present invention.
Figure 4B:
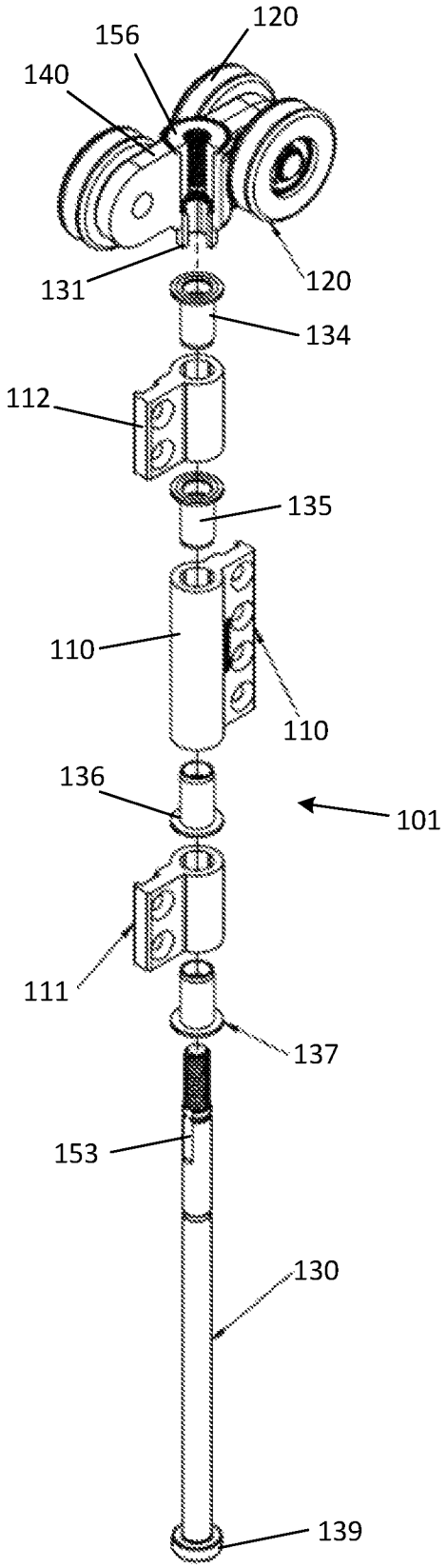
FIG. 4B illustrates an exploded view of a height-adjustable carriage hanger of FIG. 1 according to an alternative embodiment of the present invention.
Figure 5:
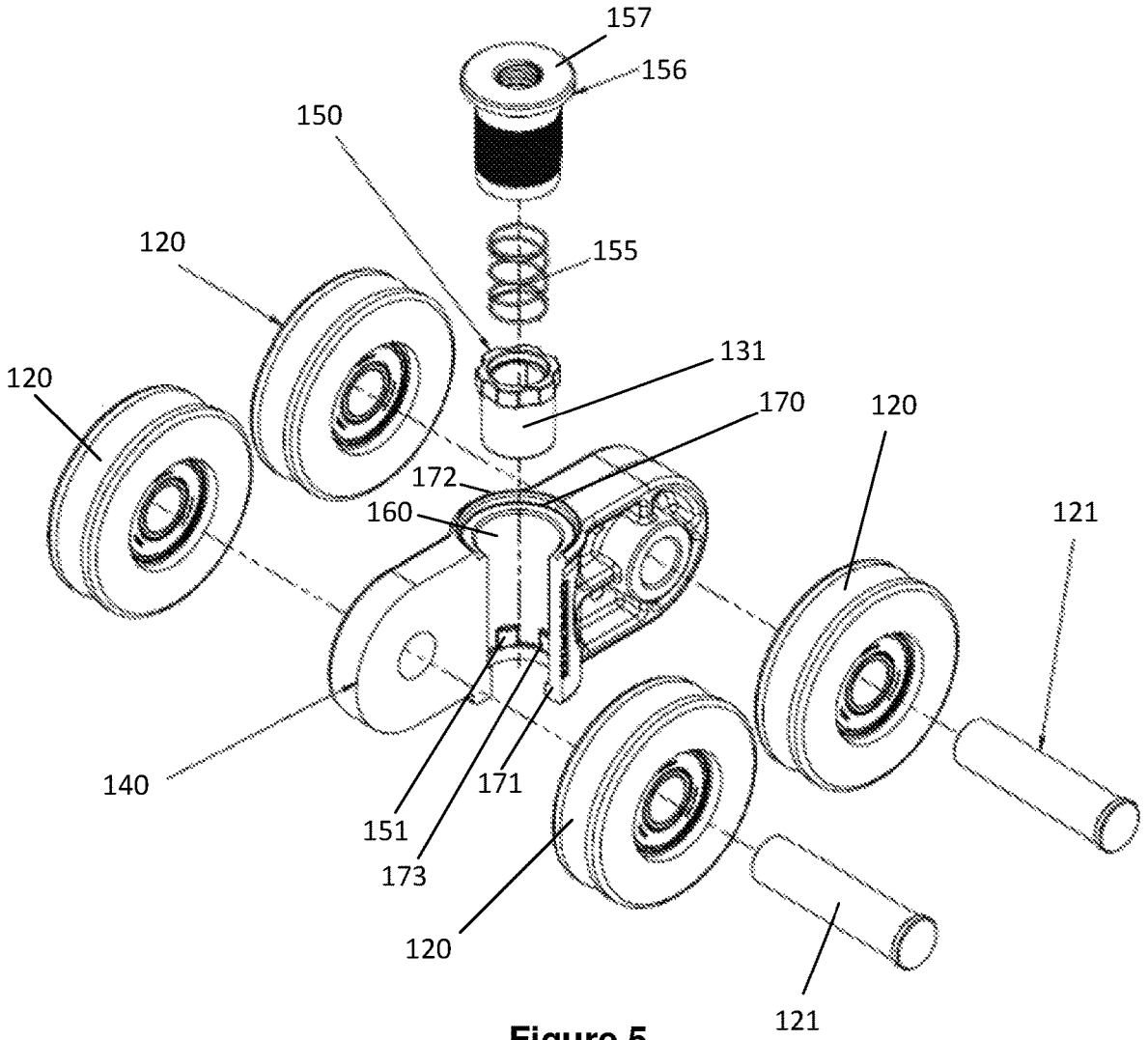
FIG. 5 illustrates an exploded view of the body of a height-adjustable carriage hanger according to an embodiment of the present invention.

The anti-rotating sleeve 131 in a first position illustrated in FIG. 2 prevents the rod 130 from rotating relative to the hanger nut 156. In a second position illustrated in FIG. 3 the anti-rotating sleeve 131 is pushed up against the spring 155 by a bush 132 so that the protrusions 150, 151 disengage, allowing the anti-rotating sleeve 131 to rotate and thus allow the rod 130 to rotate in the hanger nut 156. The bush need not be externally cylindrical and as illustrated in FIG. 4B bush 132 is optional and need not be present, the anti-rotating sleeve 131 may be pushed up by hand or by a tool.

The rotation of the rod 130 allows the extension of the rod 130 to be adjusted and so adjusts the height of the hinges 110, 111, 112 relative to the body 140 of the carriage hanger 101 and thus the height of any panels suspended from the hanger relative to the track that the carriage hanger 101 is mounted from.

A number of hinge plate bushes 134, 135, 136, 137 are also used. The bushes providing wear resistance. In one embodiment illustrated in FIG. 4A a washer separates bushes 132 and 134 allowing bush 132 to easily separate from bush 134 when bush 132 is used to push anti-rotating sleeve 131 against the spring. As illustrated in FIG. 4B bush 132 is optional and need not be present, washer is also not needed.

Figure 23:
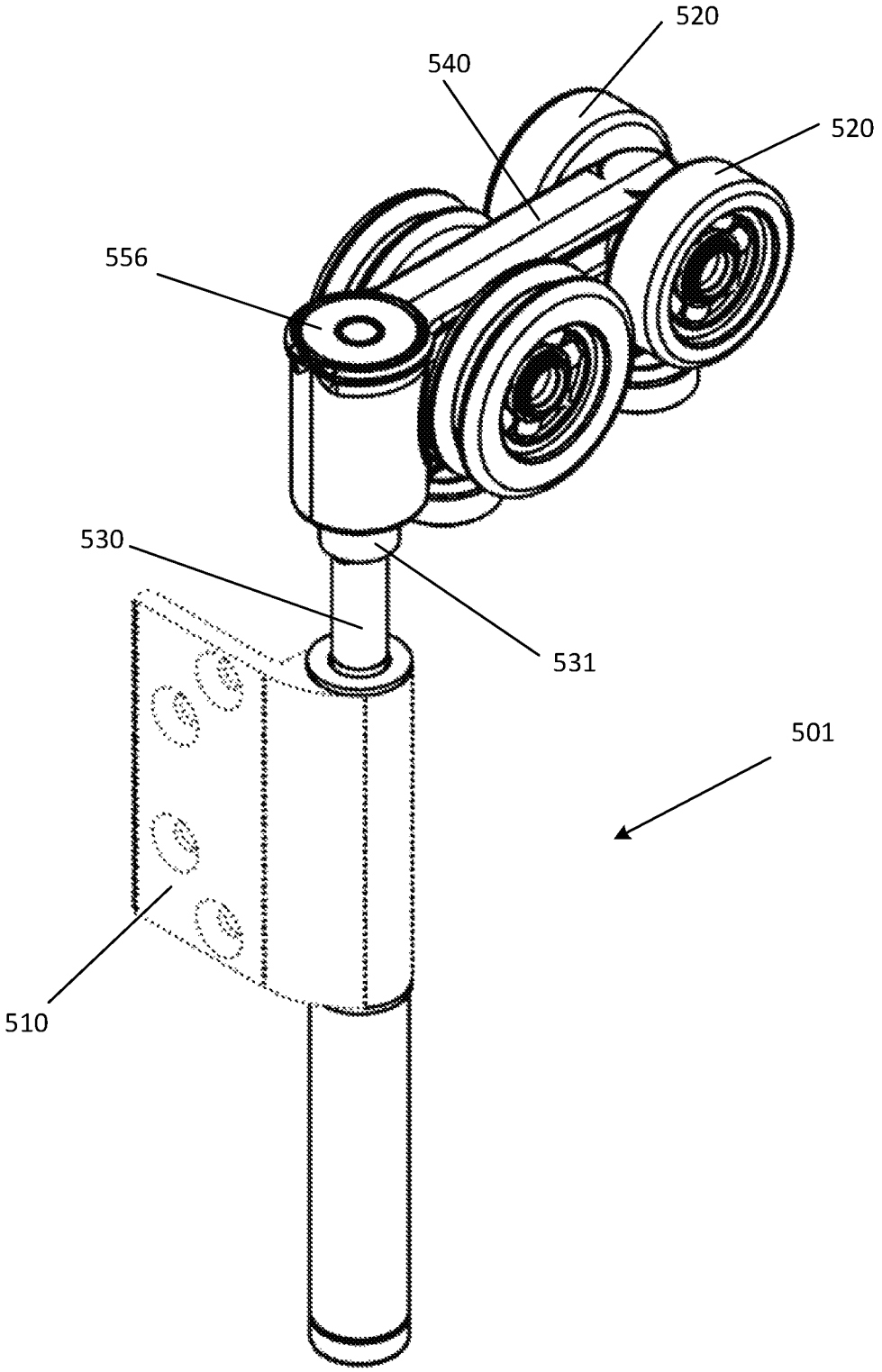
FIG. 23 illustrates an isometric view of height-adjustable carriage hanger for an end panel according to an embodiment of the present invention.

Referring to FIG. 23 an alternative embodiment of a carriage hanger 501 is illustrated. The carriage hanger 501 in FIG. 23 is for use on the end panel of a set of panels. In this arrangement, the cavity into which a threaded sleeve or hanger nut 556 is inserted is at one end instead of the centre of the body 540 as it is in carriage hanger 101. The anti-rotating sleeve 531 is the same as the anti-rotating sleeve 131 in the embodiment illustrated by carriage hanger 101. The location of the cavity and hanger nut 556 at an end allows the carriage in use on a carriage track to not extend (or only minimally protrude) past the panel to which the carriage hanger 501 is attached.

Figure 15:
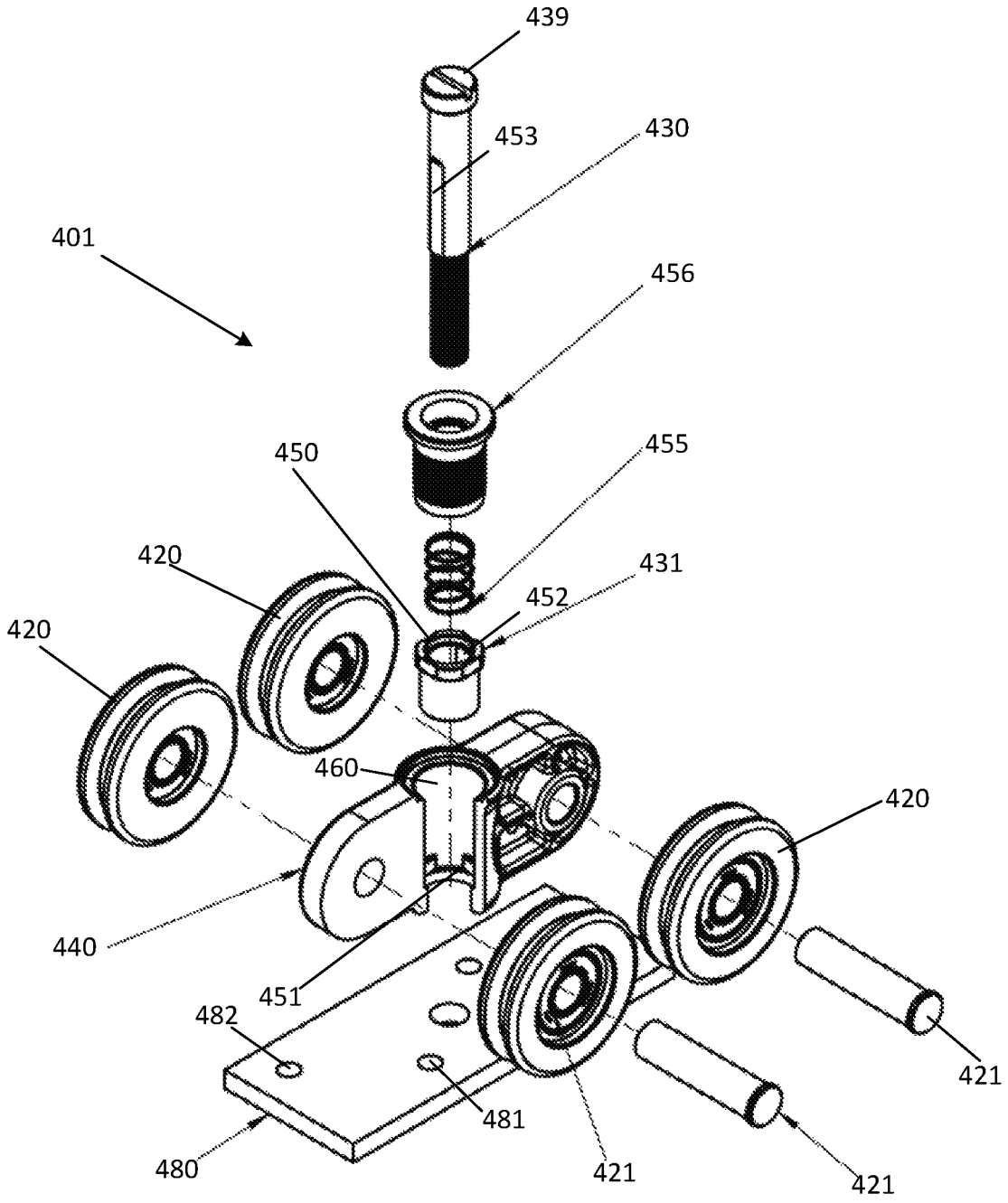
FIG. 15 illustrates an exploded view of the height-adjustable carriage hanger of FIG. 13 to a further embodiment of the present invention.

A further alternative embodiment of a carriage hanger is illustrated in FIGS. 14 and 15. The height-adjustable carriage hanger 401 consists of a body 440 and rollers 420 that rolls on the track. The rollers 420 are rotatably connected to the body 440 using axles 421. A hanger bearing or bush 456 is inserted into the body 440. A threaded supporting rod 430 having a head 439 is passed through and is rotatable in bush 456. The head 439 and the bush 456 being sized to prevent the head 439 from passing through the bush 456. A panel supporting bracket 480 has a threaded hole 481 into which the supporting rod 430 is screwed. The supporting bracket 480 has a number of holes 482 through which screws or other fastening members can be passed to attach the supporting bracket 480 to a panel.

The rotation of the rod 430 in the threaded hole 481 adjusts the length of the rod 430 altering the distance between the bracket 480 and the body 440 and thus alters the distance between a panel and a track.

Referring to FIG. 15 an anti-rotating sleeve 431 has protrusions or castellations 450 that combine with protrusions or castellations 451 in the body cavity 460 to prevent the anti-rotating sleeve 431 rotating relative to the body 440. The anti-rotating sleeve 431 is inserted into the body cavity 460 before the bush 456. A spring 455, resilient member or other biasing means is located between the bush 456 and the anti-rotating sleeve 431 and provides a force to keep the protrusions 450 of the sleeve 431 and the protrusions 451 of the body cavity 460 engaged. As discussed above other biasing means could be used.

The interior of the anti-rotating sleeve 431 is keyed, in one example the key is a flat surface 452. The keyed surface 452 engages with a similar keyed surface 453 on the rod 430 to prevent the rod 430 rotating relative to the anti-rotating sleeve 431. The rod 430 is keyed or mated for at least a portion of the rod length. Other example ways to key the anti-rotating sleeve 431 and rod 430 include splines, hex or keyways. In this embodiment, the keyed surface of the rod provides an in use means for rotating the rod when the anti-rotating sleeve castellations 450 are disengaged from the body cavity castellations 451 by pushing or moving the anti-rotating sleeve 451 to an unlocked position. A suitable tool would be used that matched the key of the rod 430 and able to rotate the rod 430.

FIGS. 7 to 13 illustrates an adjustable hinge 201, the hinge 201 includes hinge leaves/plates 215, 216 and 250 and a hinge pin 220 having an axis. While a split leaf using leaves/plates 215, 216 has been illustrated other leaves could be used depending on the panels and/or frame the hinge is to connect.

An adjustable leaf comprising first 251 and second plates 250 adjustably attached via a pin 221 having an axis. A screw 230 substantially horizontal to the main plane of the plates provides an adjustment mechanism that allows the distance between the hinge pin axis 220 and first plate 251 to be adjusted. While a screw has been described other threaded fasteners such as bolts or hex bolts could be used.

In use, this adjustment allows the horizontal distance between a panel and a frame or between two panels to be adjusted.

Screws 231 and 232 provide for an adjustment of the position of plate 250 along the axis of pin 221 relative to plate 251. In use, the adjustment is a vertical adjustment such that the vertical position of plate 251 relative to plate 250 and therefore the relative position of the panels or frame/panel can be adjusted relative to each other. Two screws 231, 232 are provided, in use however only the bottom screw needs to be used to raise or lower plate 250 relative to plate 251. The two positions are provided so that in use the hinge 201 can be turned over so the panel can be swung from the other direction.

Holes 275, 276 in leaf 215 and holes 273, 274 in leaf 216 allow the hinge to be fixed to panel or frame. Holes 271 and 272 allow plate 251 to be fixed to another panel or frame. It should be noted that if leaves 215, 216 are fixed to a frame then plate 251 will be fixed to a panel and vice versa. While leaves 215, 216 can be fixed to a panel and plate 251 can be fixed to a panel.

Holes 277, 278 on plate/leaf 250 align respectively with holes 280, 279 in plate 251 allowing plate 250 to also be fixed to a frame or panel. Holes 277, 278 are elongated holes that allow for the vertical adjustment of plate 250 while maintaining the alignment of holes 277/280 and 279/278.

Figure 13:
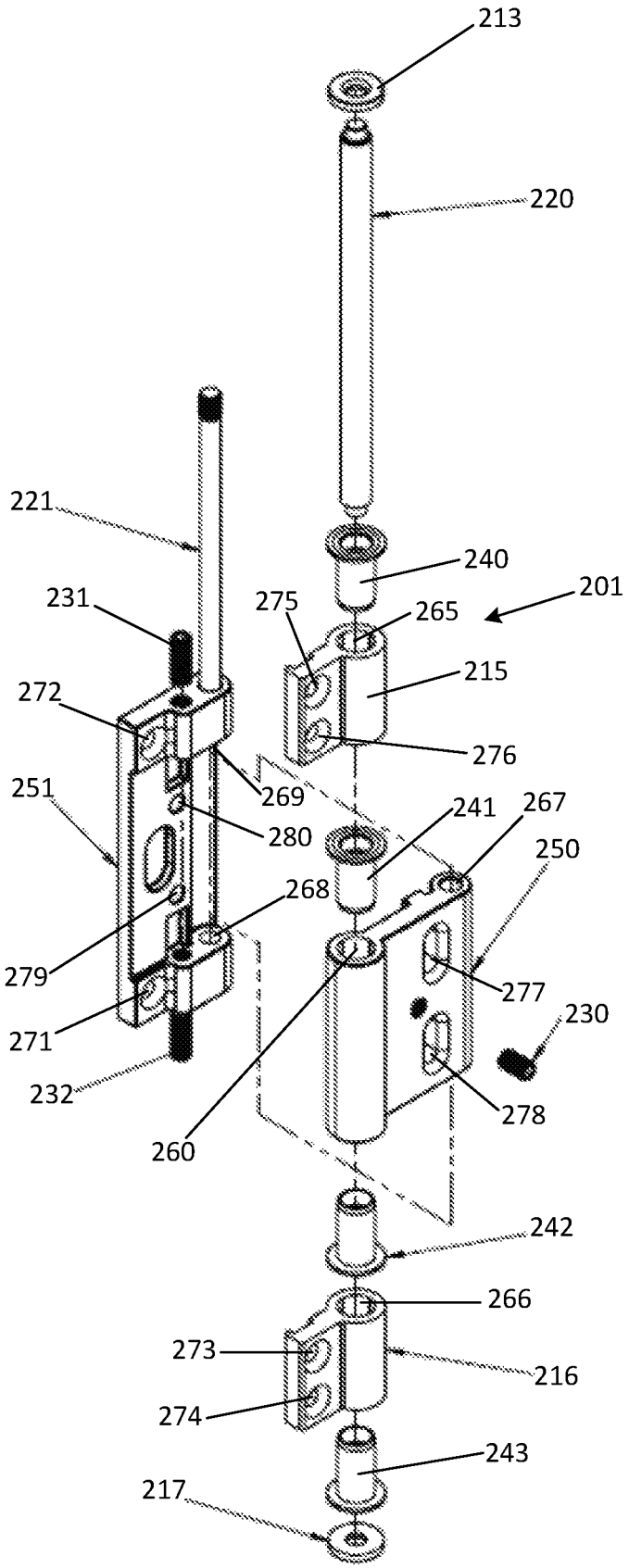
FIG. 13 illustrates an exploded view of an adjustable hinge according to an embodiment of the present invention.

Referring to FIG. 13, plate 251 is shown connected to plate 250 using pin 221. Pin sockets 268, 269 in plate 251 align with pin socket 267, which allows the plates 250, 251 to rotate relative to each other and for plate 250 to move about the axis of pin 221 relative to plate 251. Pin 221 passes through pin sockets 267, 268, 269.

Hinge leaves/plates 215, 216 have hinge pin sockets 265 and 266 respectively and plate 250 has hinge pin socket 260. A number of bushes 240, 241, 242, 243 are also used. The bushes may be made of metal, plastic, nylon or other suitable material. The bushes providing wear resistance between the hinge plates and the pin 220. Pin 220 passes through the bushes and hinge pin sockets 265, 260, 266. The hinge pin 220. is swaged at each end over the top of washers 213, 217.

Together the adjustable hinge and a height-adjustable carriage hanger allow the vertical and horizontal position of panels to be adjusted.

Figure 16:
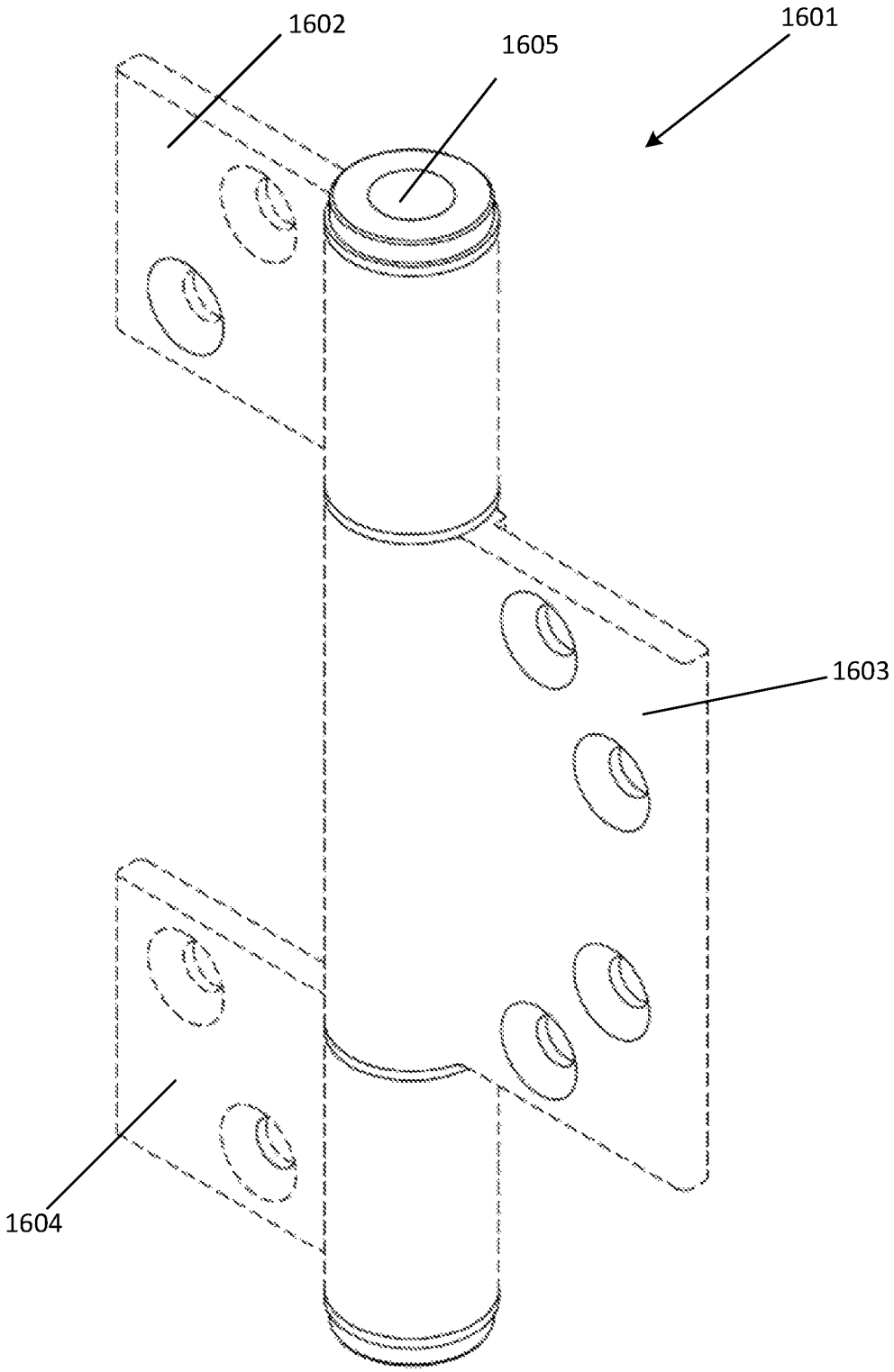
FIG. 16 illustrates an isometric view of a hinge according to an embodiment of the present invention.
Figure 17:
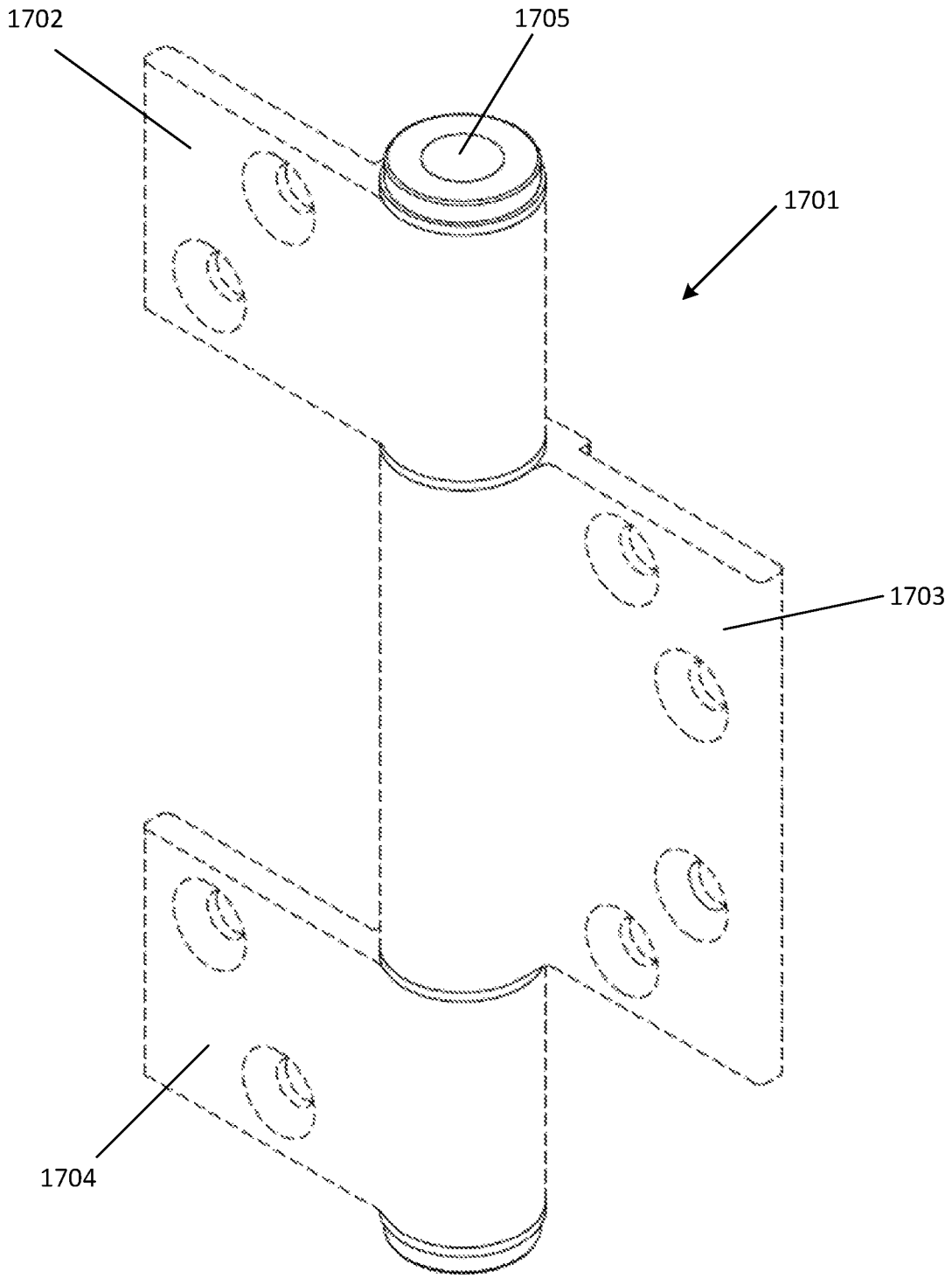
FIG. 17 illustrates an isometric view of an offset hinge according to an embodiment of the present invention.

FIGS. 16 and 17 illustrate exemplary hinges 1601, 1701 suitable for use with the system. The hinges 1601, 1701 have hinge leaves 1602, 1603, 1604, 1702, 1703, 1704 connected by a hinge pin 1605, 1705. While split leaves have been illustrated other leaf types may be used depending on the panel type.

Figure 18:
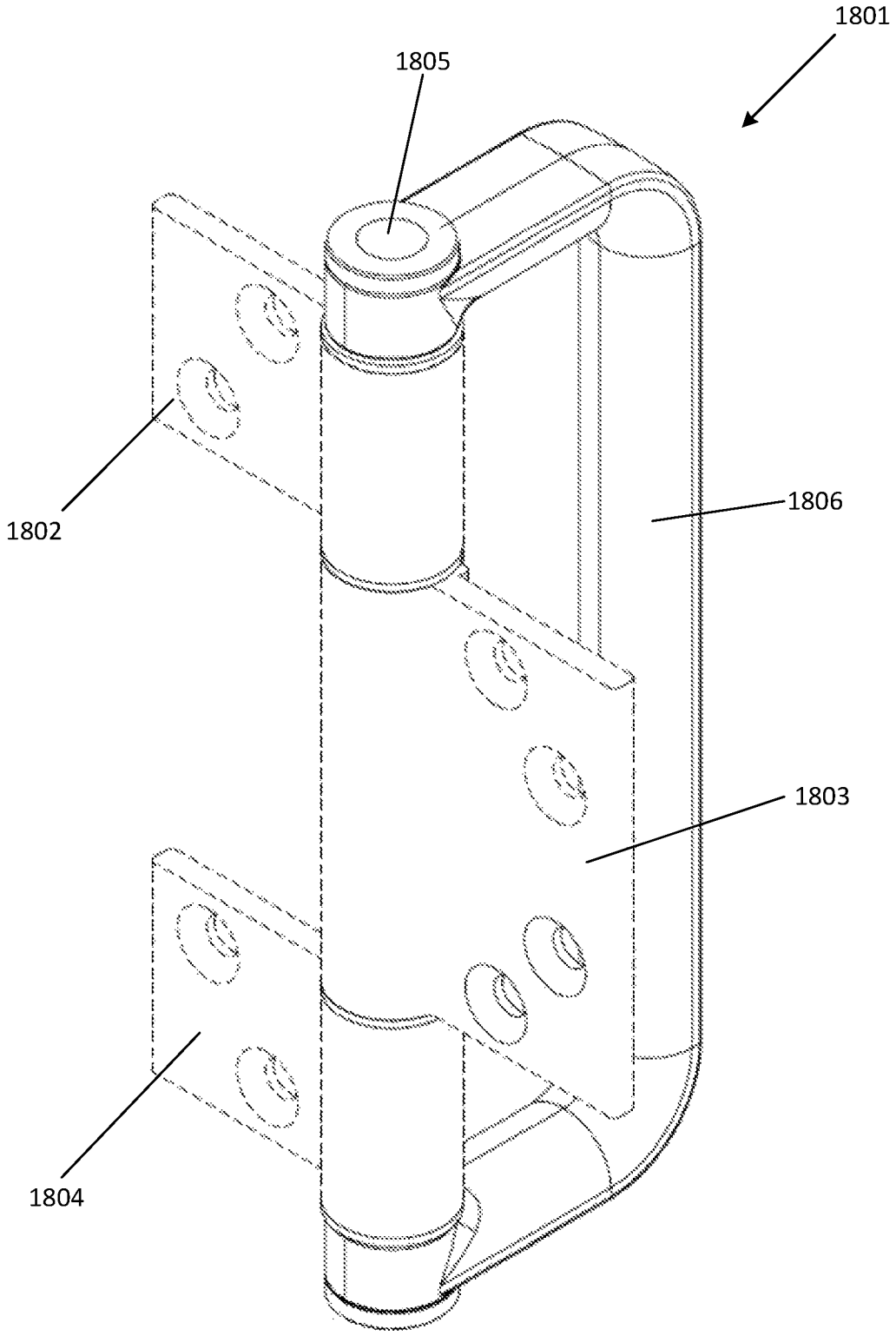
FIG. 18 illustrates an isometric view of a hinge handle according to an embodiment of the present invention.
Figure 19:
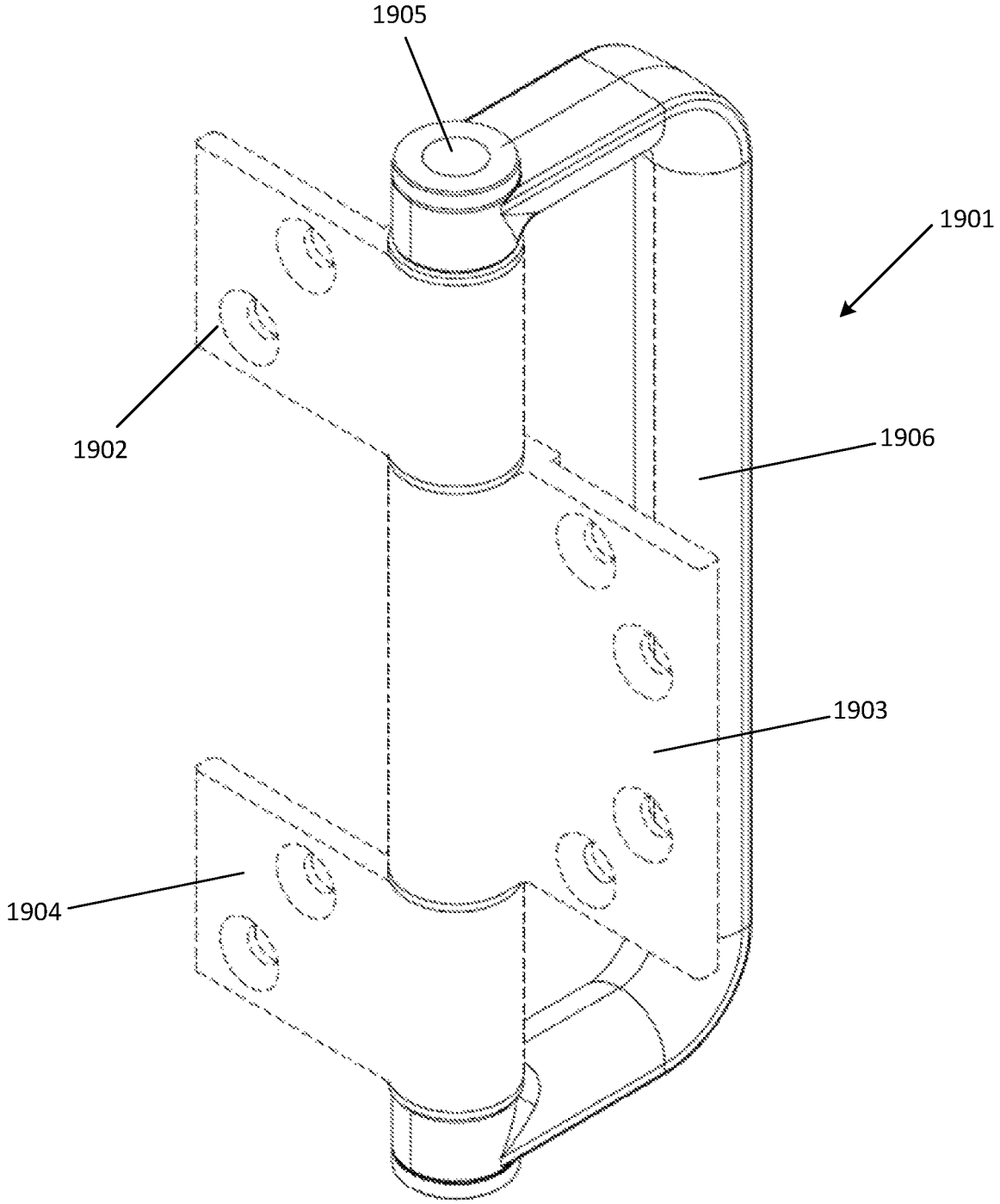
FIG. 19 illustrates an isometric view of an offset hinge handle according to an embodiment of the present invention.
Figure 20:
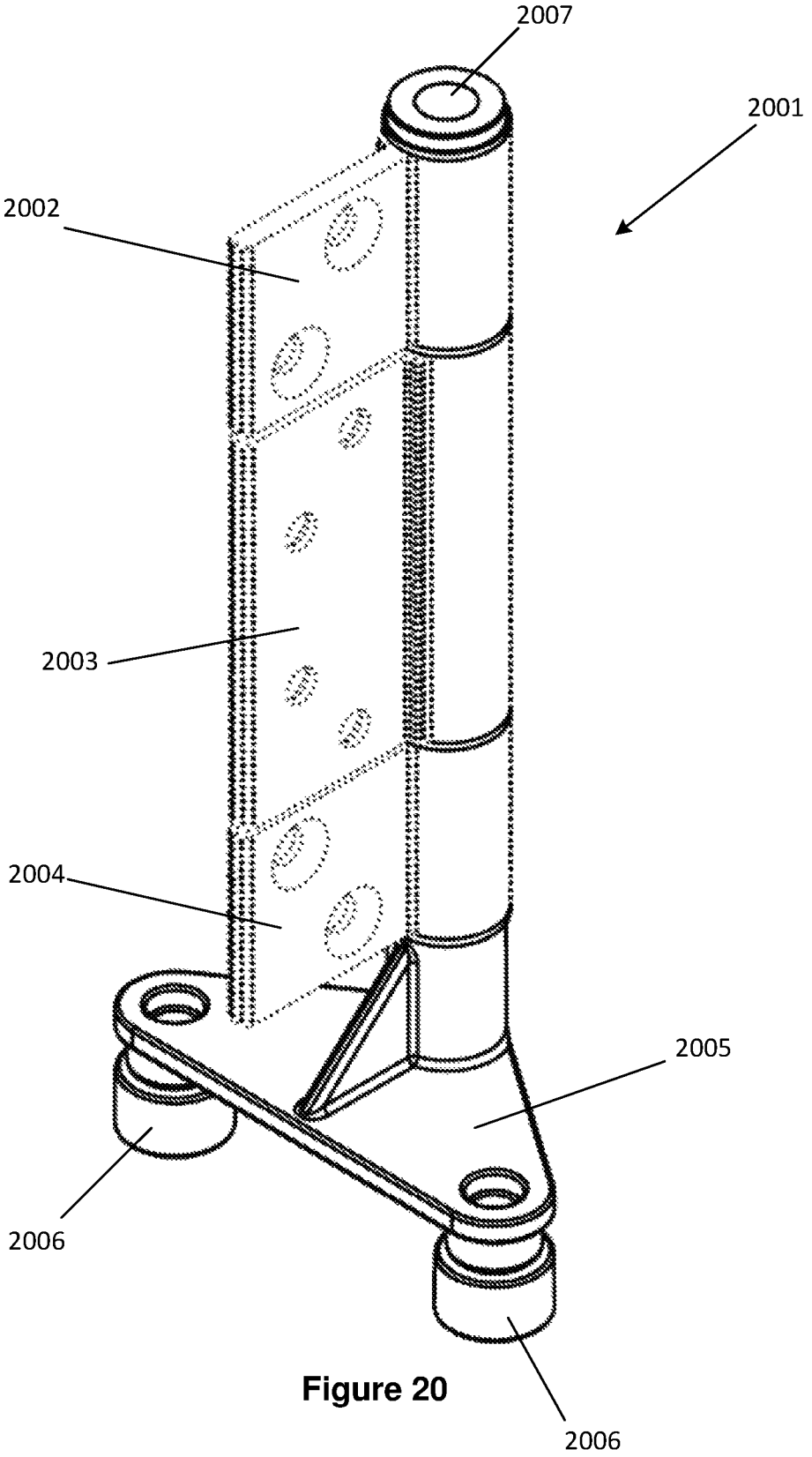
FIG. 20 illustrates an isometric view of a guide according to an embodiment of the present invention.
Figure 21A:
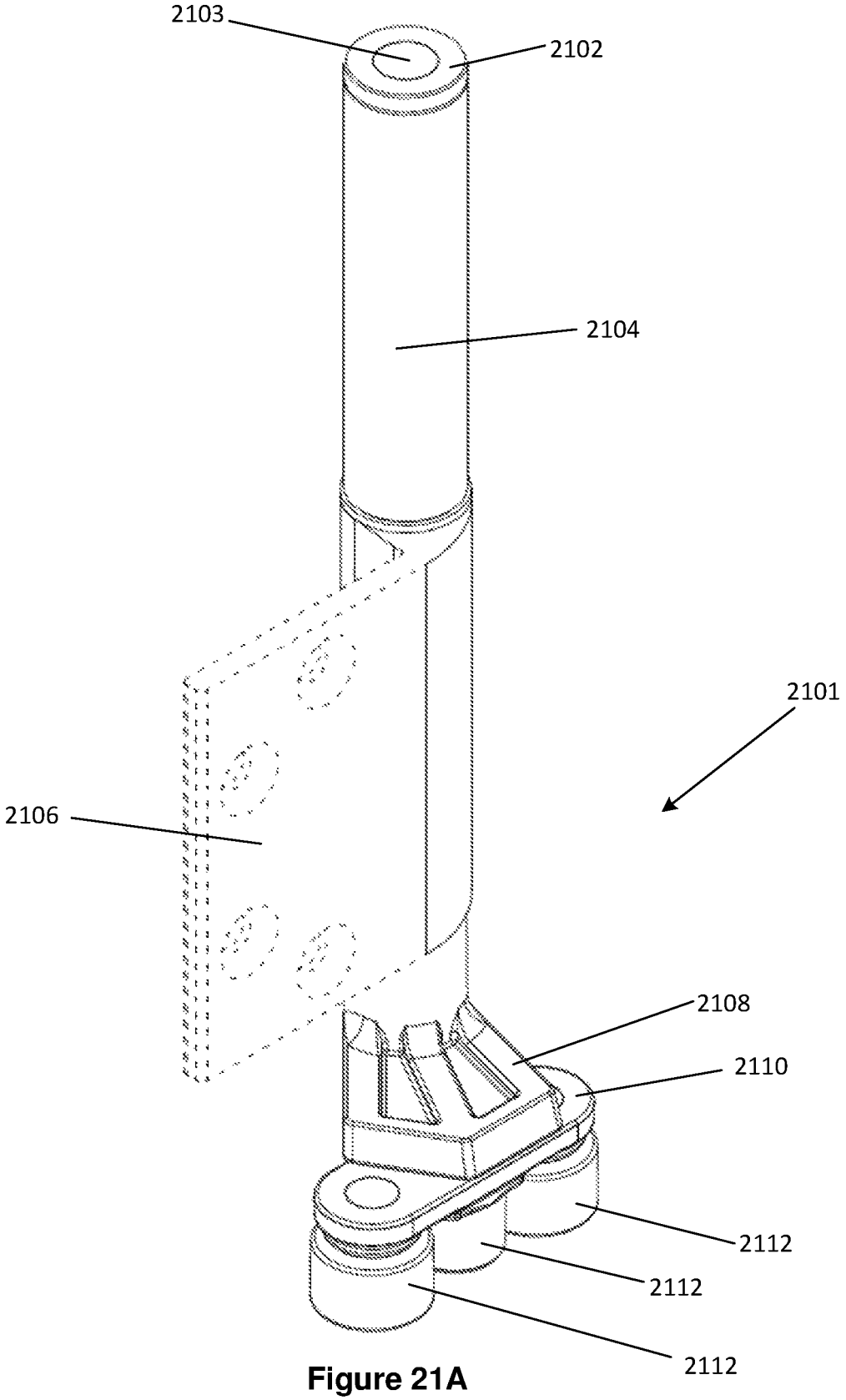
FIG. 21A illustrates an isometric view of an end guide according to an embodiment of the present invention.
Figure 21B:
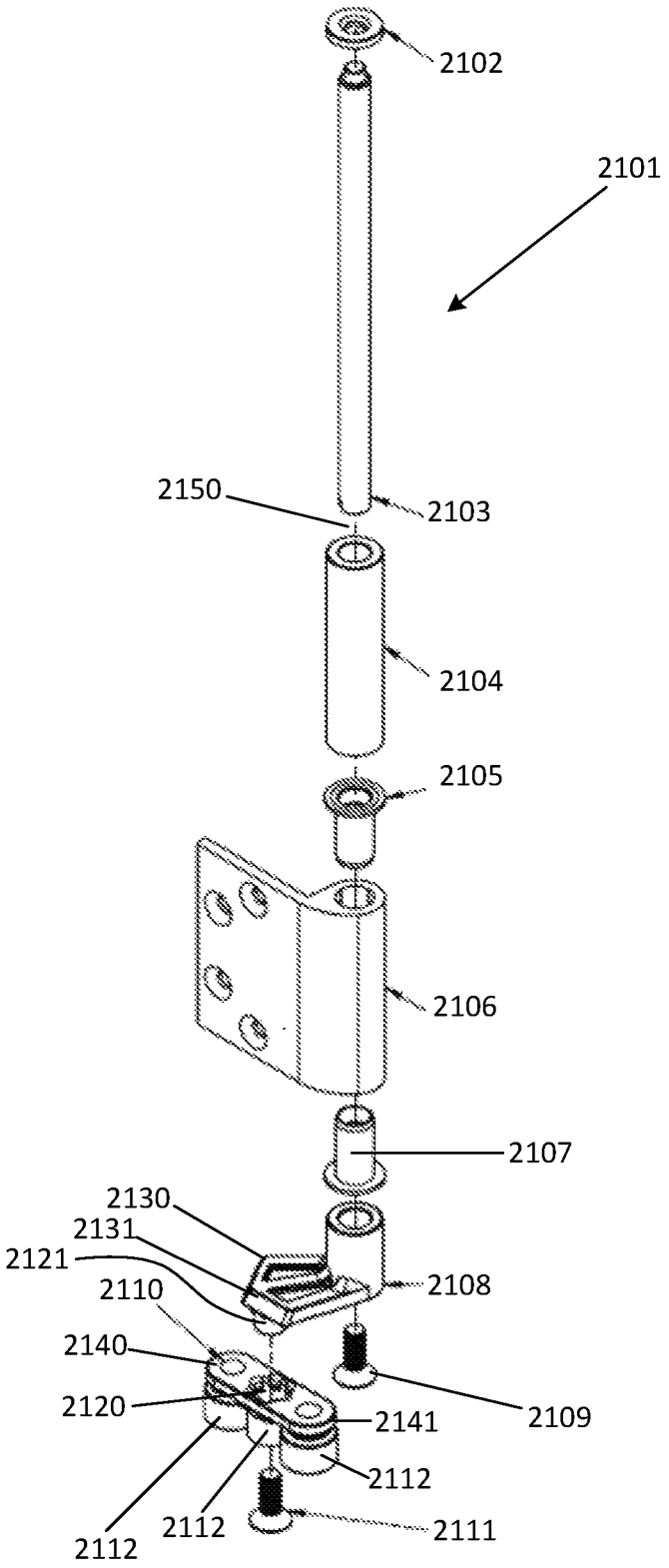
FIG. 21B illustrates an exploded view of the end guide of FIG. 21A according to an embodiment of the present invention.
Figure 22A:
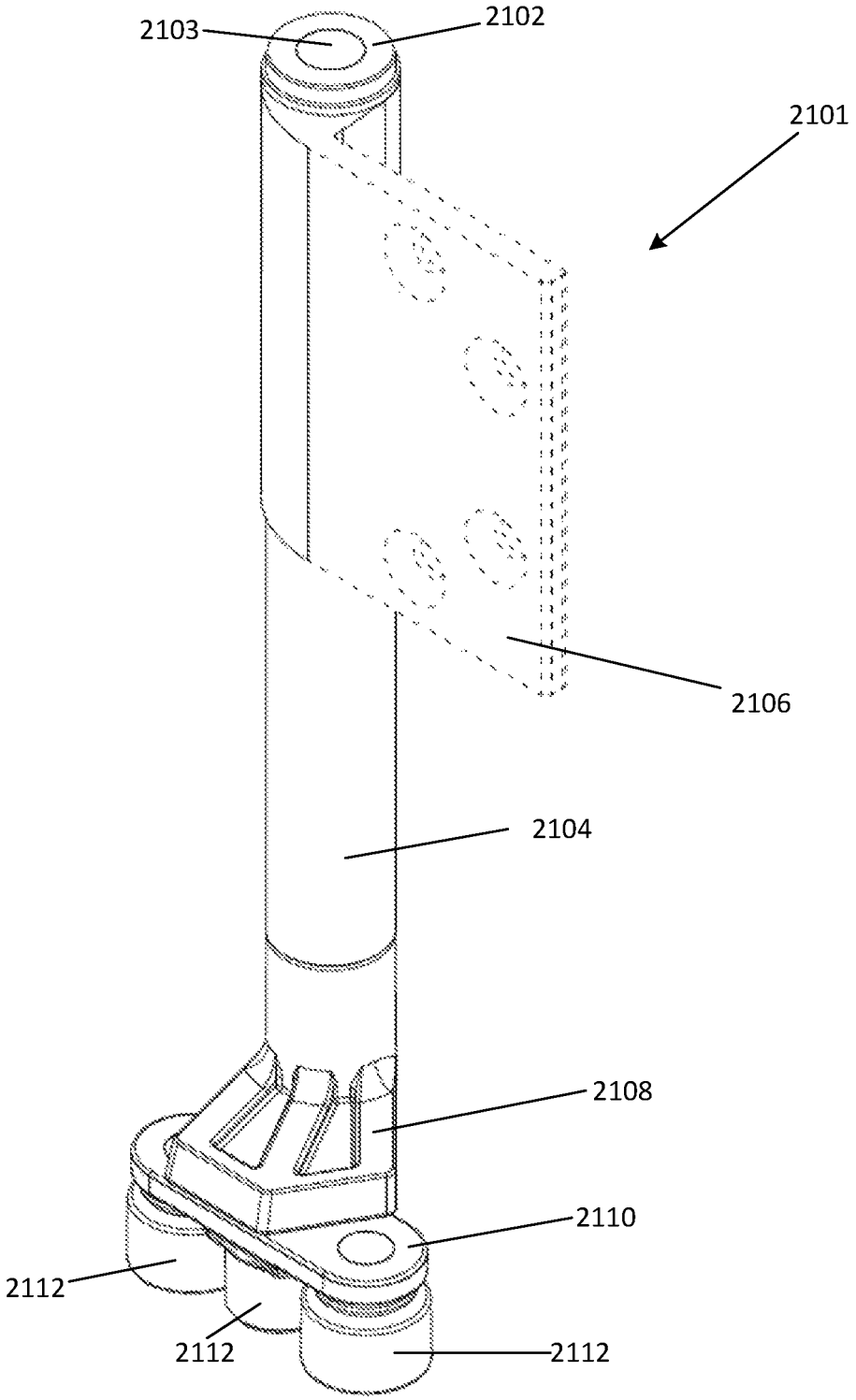
FIG. 22A illustrates an isometric view of an alternative configuration of the end guide according to an embodiment of the present invention.
Figure 22B:
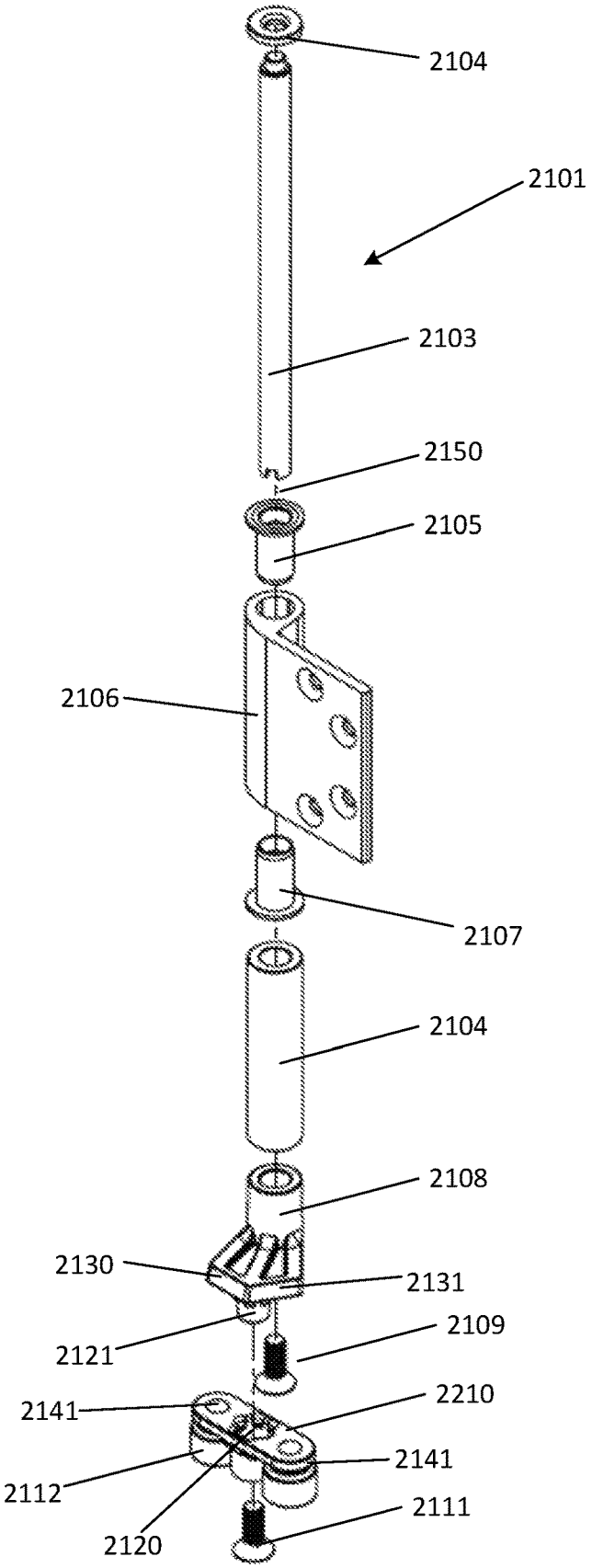
FIG. 22B illustrates an exploded view of the alternative configuration of the end guide of FIG. 22A according to an embodiment of the present invention.

FIGS. 18 and 19 illustrate exemplary hinge handles 1801, 1901 suitable for use with the system. The hinge handles 1801, 1901 have hinge leaves 1802, 1803, 1804, 1902, 1903, 1904 and a handle 1806, 1906. The hinge leaves 1802, 1803, 1804, 1902, 1903, 1904 and the handle 1806, 1906 are connected by a hinge pin 1805, 1905. While split leaves have been illustrated other leaf types may be used depending on the panel type.

FIGS. 20, 21A, 21B, 22A, 22B illustrate the panel guides 2001, 2101. Panel guide 2001 is used when two panels are to be connected and end guide 2101 is used for a single panel at the end of a set of panels.

Panel guide 2001 includes leaves 2002, 2003, 2004, guide pin 2007, guide base 2005 and guide roller 2006. In use, the rollers 2006 are located in guide track 2420.

End guide 2101 comprises a leaf 2106, guide pin 2103, end guide sleeve 2104, end guide base upper 2108, end guide roller assembly 2110 and guide rollers 2112. In use, the rollers 2112 are located in guide track 2420 and spaced along the length of the end guide roller assembly 2110.

The position of the leaf 2106 may be altered by swapping the leaf 2106 and the end guide sleeve 2104. Comparing FIGS. 21A-B with FIGS. 22A-B, in FIGS. 21A-B the leaf 2106 is in the lower position and in FIGS. 22A-B the leaf is in the upper position. Also the offset hinge leaves are facing opposite directions relative to the top and the bottom of the end guide. The swapping of position is achievable as guide pin 2103 is swaged at the upper end with a sleeve/washer 2104, but at the lower end of the guide pin 2103 the guide pin 2103 is secured to the end guide base upper 2108 using a screw 2109 or other suitable fasteners. Bushes 2105 and 2107 are used to provide wear resistance between the leaf 2106 and the end guide pin 2103. The bushes may be made of metal, plastic, nylon or other suitable material.

End guide 2101 may be used with left or right opening end panels as end guide base upper 2108 and end guide roller assembly 2110 are positionable by keyed protrusion 2121 extending from end guide base upper 2108 and keyed cavity 2120 centred between ends 2140 and 2141 along the length of end guide roller assembly 2110.

In a first position when surface 2130 is parallel to the longitudinal axis of end guide roller assembly 2110, the axis

2150 of guide pin is shifted towards end 2140 such that in use the end guide roller assembly would not (or minimally) protrude beyond the end of panel.

In a second position when surface 2131 is parallel to the longitudinal axis of end guide roller assembly 2110, the axis 2150 of guide pin is shifted towards end 2141 such that in use the end guide roller assembly would not (or minimally) protrude beyond the end of panel.

Once a position is decided upon the end guide base upper 2108 and end guide roller assembly 2110 are secured using a screw 2111 or other suitable securing mechanism.

The ability to change the alignment of end guide base upper 2108 and the end guide roller assembly 2110 means that the same end guide 2101 can be used with end panels at either end of a frame and guide pin 2103 can be positioned either side of slidable panels.

While the present invention has been illustrated by the description of the embodiments thereof, and while the embodiments have been described in detail, it is not the intention of the Applicant to restrict or in any way limit the scope of the appended claims to such detail. Additional advantages and modifications will readily appear to those skilled in the art. Therefore, the invention in its broader aspects is not limited to the specific details, representative apparatus and method, and illustrative examples shown and described. Accordingly, departures may be made from such details without departure from the spirit or scope of the Applicant's general inventive concept.

The invention claimed is:

1. A panel carriage hanger configured to travel along a track, the panel carriage hanger comprising:

a body;

rollers attached to the body;

a cylindrical bore in the body, the axis of the cylindrical bore configured to be substantially vertical when the carriage hanger is secured to a track, the cylindrical bore having first and second ends, the cylindrical bore having a lip substantially at a first end, the lip having a plurality of castellations;

an anti-rotating sleeve having:

first and second ends; and a lip at the second end with a plurality of castellations;

the anti-rotating sleeve inserted into the cylindrical bore such that the first end passes through the first end of the cylindrical bore and the castellations of the anti-rotating sleeve mateable with the castellations of the cylindrical bore, the interior of the anti-rotating sleeve having a keyed portion, the anti-rotating sleeve movable substantially upwards from a first position in the bore where the castellations of the anti-rotating sleeve and the castellations of the cylindrical bore mate such that the anti-rotating sleeve cannot rotate into a second position in the bore where the anti-rotating sleeve can rotate in the bore;

a biasing mechanism providing a substantially downwards force to the anti-rotating sleeve to mate the castellations of the anti-rotating sleeve with the castellations of the cylindrical bore;

a panel attachment mechanism; and a rod having first and second ends, the rod passing through the anti-rotating sleeve, the second end of the rod supported at the second end of the cylindrical bore by a rod support member, the rod further having a keyed portion, the keyed portion of the rod mating with the keyed portion of the anti-rotating sleeve, such that the anti-rotating sleeve and the rod rotate together, the first end of the rod connected to the panel attachment mechanism, wherein rotating the rod when the anti-rotating sleeve is in the second position adjusts the distance between the rod support member and the panel attachment mechanism.

2. The panel carriage hanger of claim 1 wherein the rod support member is a threaded sleeve inserted into the cylindrical bore substantially at the second end of the cylindrical bore and wherein the rod is threaded at least partially at the second end of the rod and the rod is screwed into the threaded sleeve.

3. The panel carriage hanger of claim 1 wherein the panel attachment mechanism is at least one hinge plate.

4. The panel carriage hanger of claim 1 wherein the panel attachment mechanism is a leaf or bracket attachable to a panel, the leaf or bracket is substantially perpendicular to the cylindrical bore, wherein the leaf or bracket has a threaded bore and wherein the rod is threaded at least partially at the first end of the rod and the rod is screwed into the threaded bore.

5. The panel carriage hanger of claim 1 wherein the biasing mechanism is a spring.

6. The panel carriage hanger of claim 1 wherein the track is mounted above a plurality of panels and at least one of the panels is hung from the rod support member.

7. The panel carriage hanger of claim 6 wherein at least one of the plurality of panels is a door.

8. A multi panel system comprising:

a plurality of panels;

a plurality of hinges connecting at least one of the plurality of panels to a frame and connecting at least one of the plurality of panels to another of the plurality of panels;

at least one panel carriage hanger of claim 1; and a track along which the at least one panel carriage hanger can travel.

9. The multi panel system of claim 8 wherein at least one of the hinges connecting the at least one of the plurality of panels to the frame is an adjustable hinge; the adjustable hinge comprising:

a hinge leaf securable to the at least one of the plurality of panels or a frame; and an adjustable leaf securable to the at least one of the plurality of panels or a frame, the adjustable leaf comprising first and second plates, the first and second plates being connected by an adjustable leaf pin, the second plate being connected to the hinge leaf by a hinge pin substantially parallel to the adjustable leaf pin, the hinge pin defining a hinge pin axis, the first and second plates being movable relative to each other such that the distance between the first plate and the hinge pin axis is adjustable to alter the space between a frame and the at least one of the plurality of panels to which the adjustable hinge is attached and the first and second plates being adjustable along the hinge pin axis such that the height of the at least one of the plurality of panels relative to the frame is adjustable.

10. The multi panel system of claim 9 wherein the distance between the first plate and the hinge pin axis is adjustable, the adjustable hinge including a hinge pin adjustment screw.

11. The multi panel system of claim 9 wherein the relative position of the plates along the axis of the hinge pin is adjustable the adjustable hinge including at least one plate adjustment screw to position the first plate relative to the second plate.

12. The multi panel system of claim 9 further including:

a guide track; and an end guide locatable in the guide track to guide one of the plurality of panels, the end guide comprising:

an end guide leaf or an end guide bracket securable to at least one of the plurality of panels;

a guide base upper having a top and a bottom;

a pin connecting the end guide leaf or end guide bracket to the top of the guide base upper, the pin defining a pin axis; and an elongated roller assembly having first and second ends, having a keyed cavity between the first and second ends, the keyed cavity positionable in a keyed protrusion, the keyed protrusion protruding from the bottom of the guide base upper, the roller assembly further having a plurality of rollers arranged along the elongated roller assembly slidable along the guide track;

wherein the guide base upper and elongated roller assembly are connectable in at least a first position wherein the pin axis is located nearer the first end of the elongated roller assembly than the second end and a second position wherein the pin axis is located nearer the second end of the elongated roller assembly than the first end.

13. The multi panel system of claim 12 wherein the keys of the cavity and the protrusion are castellations.

14. The multi panel system of claim 12 further including locating surfaces on the guide base upper, the locating surfaces alignable with a side of the elongated roller assembly to define connection positions.

* * * * *